US010041635B2

(12) United States Patent
Lam et al.

(10) Patent No.: US 10,041,635 B2
(45) Date of Patent: Aug. 7, 2018

(54) LIGHTING AND DIFFUSER APPARATUS FOR A FLASHLIGHT

(71) Applicant: Man Yin Lam, Kowloon (HK)

(72) Inventors: Man Yin Lam, Kowloon (HK); Daniel Kai Yu Lam, Kowloon (HK)

( * ) Notice: Subject to any disclaimer, the term of this patent is extended or adjusted under 35 U.S.C. 154(b) by 444 days.

(21) Appl. No.: 14/944,196

(22) Filed: Nov. 17, 2015

(65) Prior Publication Data

US 2016/0161069 A1 Jun. 9, 2016

(30) Foreign Application Priority Data

Nov. 19, 2014 (HK) ..... 14111692.2

(51) Int. Cl.

| | |
|---|---|
| ***F21L 4/00*** | (2006.01) |
| ***F21L 4/02*** | (2006.01) |
| ***F21V 23/04*** | (2006.01) |
| ***F21V 7/00*** | (2006.01) |
| *F21V 3/02* | (2006.01) |
| *F21V 13/02* | (2006.01) |
| *F21Y 115/10* | (2016.01) |
| *F21V 3/06* | (2018.01) |

(52) U.S. Cl.

CPC ..... *F21L 4/027* (2013.01); *F21V 7/0075* (2013.01); *F21V 23/0414* (2013.01); *F21V 3/02* (2013.01); *F21V 3/061* (2018.02); *F21V 3/062* (2018.02); *F21V 13/02* (2013.01); *F21Y 2115/10* (2016.08)

(58) Field of Classification Search

CPC ... F21L 4/005; F21L 4/00; F21L 4/027; F21L 4/045; F21V 23/0414; F21V 15/01; F21V 21/0885; F21V 13/02; F21V 13/045; F21V 7/00; F21V 14/025; F21V 14/065; F21V 14/085

USPC ..... 362/196–208

See application file for complete search history.

(56) References Cited

U.S. PATENT DOCUMENTS

| | | | | |
|---|---|---|---|---|
| 4,290,095 | A | 9/1981 | Schmidt | |
| 5,045,980 | A | 9/1991 | Harvey | |
| 5,165,781 | A | 11/1992 | Orak | |
| 5,622,423 | A | 4/1997 | Lee | |
| 5,629,105 | A * | 5/1997 | Matthews | F21L 4/08 362/184 |
| 5,752,761 | A | 5/1998 | Pietruczynik et al. | |
| 5,871,272 | A * | 2/1999 | Sharrah | F21L 4/025 362/184 |
| 6,012,824 | A | 1/2000 | Sharrah et al. | |
| 6,045,236 | A | 4/2000 | Cheng et al. | |

(Continued)

*Primary Examiner* — William Carter

(74) *Attorney, Agent, or Firm* — Law Office of Arthur M. Antonelli, PLLC

(57) ABSTRACT

The present invention relates to a lighting and diffuser apparatus for a flashlight. In one aspect, the lighting and diffuser apparatus includes a reflector. The reflector may include an interior surface having a truncated parabolodial shape, as well as an exterior surface which includes a first segment that defines a lateral surface of a frustum of a right circular cone. The lighting and diffuser apparatus further may include a primary light source inside the reflector, and a secondary light source outside the reflector. The secondary light source may include an array of light sources facing the first segment. The array of light sources may be distributed in a ring. The lighting and diffuser apparatus also may include a cylindrical member of light transmitting material near the reflector.

37 Claims, 21 Drawing Sheets

(56) References Cited

U.S. PATENT DOCUMENTS 6,109,763 A 8/2000 Ohta et al.
6,161,939 A 12/2000 Bansbach
6,183,100 B1 2/2001 Suckow et al.
6,206,541 B1 3/2001 Landamla
6,280,652 B1 8/2001 Inoue et al.
6,464,373 B1 10/2002 Petrick
6,481,869 B1 11/2002 Horandel et al.
6,485,160 B1 11/2002 Sommers et al.
6,505,958 B2 1/2003 Ooms et al.
6,637,921 B2 10/2003 Coushaine
6,642,667 B2 11/2003 Avis
6,719,442 B1 4/2004 Chen
6,722,772 B2 4/2004 Maglica
6,749,320 B1 6/2004 Hartley
6,808,290 B2 10/2004 Lee
6,841,941 B2 1/2005 Kim et al.
6,880,951 B2 4/2005 Yoon
6,921,181 B2 7/2005 Yen
6,932,476 B2 8/2005 Sudo et al.
7,059,744 B2 6/2006 Sharrah
7,083,297 B2 8/2006 Matthews et al.
7,083,300 B2 8/2006 Sharrah et al.
7,125,140 B2 10/2006 Koch et al.
7,140,748 B2 11/2006 Chien
7,152,994 B2 12/2006 Huang
7,186,002 B2 3/2007 Matthews et al.
7,246,917 B2 7/2007 Rhoads et al.
7,293,891 B2 12/2007 Herold
7,309,147 B2 12/2007 Martin
RE40,015 E 1/2008 Belliveau
7,314,280 B2 1/2008 Iwase
7,344,268 B2 3/2008 Jigamian
7,347,581 B2 3/2008 Krieger
7,360,920 B2 4/2008 Dalton et al.
7,387,402 B1 6/2008 Lui
7,401,941 B2 7/2008 Teng et al.
7,425,084 B2 9/2008 Ruud et al.
7,434,955 B2 10/2008 Vickers et al.
7,461,945 B2 12/2008 Shiau
7,490,951 B2 2/2009 Klipstein et al.
7,494,247 B2 2/2009 Wen
7,503,671 B2 3/2009 Kang et al.
7,534,975 B1 5/2009 Sharrah et al.
7,562,996 B2 7/2009 Maglica
7,604,371 B2 10/2009 Bushee et al.
7,614,767 B2 11/2009 Zulim et al.
7,618,154 B2 11/2009 Rosiello
7,635,195 B2 12/2009 Tarter
7,651,239 B2 1/2010 Spartano et al.
7,677,759 B1 3/2010 Leung
7,722,209 B2 5/2010 Matthews et al.
7,745,957 B2 6/2010 Bayat et al.
7,758,205 B2 7/2010 Liu
7,780,309 B2 8/2010 McMillan et al.
7,784,963 B2 * 8/2010 Galli ..... F21L 4/00 362/184
7,819,549 B2 10/2010 Narendran et al.
7,903,140 B2 * 3/2011 Metala ..... H04N 7/185 362/184
7,905,624 B2 3/2011 Bushee et al.
8,033,680 B2 10/2011 Sharrah et al.
8,087,797 B2 1/2012 Pelletier et al.
8,087,808 B2 1/2012 Hu
8,104,916 B2 1/2012 Liu
8,152,327 B2 4/2012 Brands et al.
8,186,846 B2 5/2012 Bertken
8,210,707 B2 7/2012 Wang
8,210,710 B2 7/2012 Koch et al.
8,328,398 B2 12/2012 Van Deursen
8,366,290 B2 2/2013 Maglica
8,366,293 B2 * 2/2013 McDermott ..... F21L 4/027 362/190
8,371,710 B2 2/2013 Gupta et al.
8,395,006 B2 3/2013 Koch et al.
8,449,136 B2 5/2013 Palmer et al.
8,474,994 B2 7/2013 Campman
8,507,819 B2 8/2013 Steinicke et al.
8,545,043 B2 10/2013 Yeh
8,556,446 B2 10/2013 Campman
8,573,796 B2 11/2013 Opolka
8,584,392 B1 11/2013 Young
8,602,577 B2 12/2013 Luo et al.
8,632,203 B2 1/2014 Kim
8,632,223 B2 1/2014 McDermott
8,641,225 B2 2/2014 Yeh
8,662,702 B2 3/2014 Datz et al.
8,672,519 B2 3/2014 Schaefer et al.
8,678,611 B2 3/2014 Chu et al.
8,696,174 B2 4/2014 Shpizel
8,704,149 B2 4/2014 Hsieh et al.
8,721,111 B2 5/2014 Yeh
8,727,573 B2 5/2014 Holder
8,746,935 B2 6/2014 Popper et al.
8,752,977 B2 6/2014 Popper et al.
8,764,217 B2 7/2014 Hao
8,764,232 B2 7/2014 Wilcox
8,770,806 B2 7/2014 Koo et al.
8,777,443 B2 7/2014 Yang
8,783,908 B2 7/2014 Gross et al.
8,783,924 B1 7/2014 Zuiderveen
8,801,218 B2 8/2014 Ariyoshi et al.
8,801,231 B2 8/2014 Kim et al.
8,801,239 B2 8/2014 Abdelsamed et al.
8,807,799 B2 8/2014 Li et al.
8,814,382 B2 8/2014 Peck
8,814,393 B2 8/2014 Froelicher et al.
8,814,396 B2 8/2014 Ishida et al.
8,820,951 B2 9/2014 Yribeni et al.
8,820,962 B2 9/2014 Kang
8,820,964 B2 9/2014 Gould
8,820,981 B2 9/2014 Jonsson
8,820,982 B2 9/2014 Chen
8,827,511 B2 9/2014 Chien
8,827,531 B2 9/2014 Richardson et al.
2004/0120157 A1 * 6/2004 Bottesch ..... B60Q 1/0052 362/487
2010/0254124 A1 * 10/2010 Bayat ..... F21L 4/027 362/206

* cited by examiner

LIGHTING AND DIFFUSER APPARATUS FOR A FLASHLIGHT

CROSS REFERENCE TO RELATED APPLICATIONS

This application claims priority under 35 U.S.C. § 119 to Hong Kong Short-term Patent No. HK1198615 filed Nov. 19, 2014, the disclosure of which is incorporated herein by reference in its entirety.

FIELD OF THE INVENTION

The present invention generally relates to a multi-mode flashlight. More particularly, this invention relates to a lighting and diffuser apparatus for portable light systems where focused beams of light or diffused area lighting may be provided.

BACKGROUND

External accessories for flashlights which convert a focused output beam to a diffused wide-angle light are known in the related art. For example, a plastic diffuser tip may be secured over the head of a flashlight to soften the light for area lighting or to convert the flashlight into a glowing wand for emergency situations or traffic control. External diffuser tip accessories, however, may increase the outer dimensions of the flashlight. This may reduce the utility of the flashlight and complicate storage of the diffuser tip-flashlight combination in a flashlight holster. External diffuser tip accessories further may need to be removed from the flashlight in order to allow the flashlight to provide focused emissions. Also, external diffuser tip accessories may need to be stored when not in use. Accordingly, a need exists for an improved flashlight reflector and diffuser system.

SUMMARY

Hence, the present invention is directed to a lighting and diffuser apparatus. The apparatus may include a reflector having a longitudinal axis, as well as a first end which comprises a first rim having a first diameter and a second rim having a second diameter. The second diameter may be greater than the first diameter. The reflector also may include a second end. The second end may be spaced from the first end along the longitudinal axis and may include a third rim having a third diameter, and a fourth rim having a fourth diameter. The fourth diameter may be greater than the third diameter. The reflector further may include an interior surface extending from the first rim to the third rim. The interior surface may have a truncated parabolodial shape. The reflector also may include an exterior surface extending from the second rim to the fourth rim. The exterior surface may include a first segment that defines a lateral surface of a frustum of a right circular cone. The apparatus further may include a primary lamp, which is positioned inside the third rim and which extends above the interior surface. The apparatus also may include a secondary lamp which includes an array of light sources facing the first segment, the array of light sources being distributed in a ring adjacent to the second end of the reflector. Also, the apparatus may include a cylindrical member of light transmitting material proximate the reflector. The cylindrical member may include a distal end portion adjacent the first end of the reflector, a proximal end portion adjacent the secondary lamp, and an interior sidewall extending from the distal end portion to the proximal end portion. The interior sidewall may define an interior passage which faces the lateral surface of the reflector such that light from the secondary lamp passes into the proximal end, and such that light from the secondary lamp which is reflected by the lateral surface of the reflector passes into the interior sidewall. The cylindrical member further may include an exterior sidewall extending from the distal end portion to the proximal end portion such that light passing through the proximal end portion and light passing through the interior sidewall is emitted from the exterior sidewall to provide a diffuse light.

The primary lamp may include a light emitting diode. The light emitting diode may be a single-die packaged light emitting diode. The primary lamp may have a light output substantially equal to or greater than 1000 lumens as measured by ANSI FL 1-2009 Standard. The primary lamp further may have a light output substantially equal to or greater than 2000 lumens as measured by ANSI FL 1-2009 Standard.

The array of light sources comprising the secondary lamp may be an array of light emitting diodes. The array of light sources may be distributed uniformly around the second end of the reflector.

The reflector may include a reflective coating on the interior surface of the reflector. Also, the reflector may include a reflective coating on the first segment.

The reflector may include a tool attachment site located on the exterior surface of the reflector located between the first segment and the second end of the reflector such that the tool attachment site allows the reflector to be held and manipulated without damaging the reflector. The tool attachment site may include a circumferential groove.

The lighting and diffuser apparatus may include a forward housing. The primary lamp, secondary lamp and cylindrical member may be connected to the forward housing. The primary lamp may be mounted on a metal core printed circuit board (metal core PCB) and the forward housing may dissipate heat conducted by the metal core PCB. The forward housing may include a front inner side wall, the front inner sidewall being opaque and circumscribing a portion of the first segment of the reflector. The cylindrical member may include a translucent engineered material. The translucent engineered material may be a polycarbonate plastic. The polycarbonate plastic may be colored.

In another aspect, the present invention relates to a multi-mode flashlight. The flashlight may include a lighting apparatus and diffuser in accordance with an embodiment of the present invention. The flashlight further may include a primary lamp circuit for driving the primary light source; a secondary lamp circuit for driving the secondary light source; a control circuit electrically connected to the primary light circuit and the secondary light circuit for controlling operation of the primary lamp and the secondary lamp; an electromechanical signaling device electrically connected to the control circuit for generating one or more control circuit input signals for regulating operation of the flashlight; and a power circuit electrically connected to the control circuit for supplying electricity to power the flashlight.

In yet another aspect, the multi-mode flashlight may include a lighting apparatus and diffuser of the present invention, and a power circuit for supplying electricity to power the multi-mode flashlight. The power circuit may be electrically connected to the primary lamp and the secondary lamp. The multi-mode flashlight further may include a control circuit connected to the power circuit for controlling operation of the primary lamp and the secondary lamp. The flashlight also may include an electromechanical signaling device electrically connected to the control circuit for generating one or more control circuit input signals for regulating operation of the flashlight.

The control circuit may include a microcontroller which is configured to receive the one or more control circuit input signals and which may be programmed to responsively operate the flashlight in one of a plurality of operational modes. The plurality of operational modes may include a first operational mode in which the first primary lamp emits light and the secondary lamp does not emit light, and a second operational mode in which the first primary lamp does not emit light and the secondary lamp emits light.

The first operational mode may include a first plurality of operational states, which may include a first operating state in which the first primary lamp produces a directed beam of light that is emitted from the first end of the reflector such that the directed beam of light may be characterized by a low level of light output relative to the other operating states in the first operational mode. The first operational mode further may include a second operating state in which the primary lamp produces a directed beam of light that is emitted from the first end of the reflector such that the directed beam of light may be characterized by a medium level of light output relative to the other operating states in the first operational mode. Additionally, the first operational mode may include a third operating state in which the primary lamp produces a directed beam of light that is emitted from the first end of the reflector such that the directed beam of light may be characterized by a high level of light output relative to the other operating states in the first operational mode.

The second operational mode may include a second plurality of operational states, which may include a fourth operating state in which the secondary lamp produces diffused light that is emitted from the cylindrical member, the diffused light being characterized by a low level of light output relative to the other operating states in the second operational mode; a fifth operating state in which the secondary lamp produces diffused light that is emitted from the cylindrical member, the diffused light being characterized by a medium level of light output relative to the other operating states in the second operational mode; and a sixth operating state in which the secondary lamp produces diffused light that is emitted from the cylindrical member, the diffused light being characterized by a high level of light output relative to the other operating states in the second operational mode.

The first operational mode may include a seventh operating state in which the primary lamp produces a directed beam of light that is emitted from the first end of the reflector, the directed beam of light being characterized by a very high level of light output relative to the other operating states in the first operational mode.

The first operational mode may include an eighth operating state in which the primary lamp produces a directed beam of light that is emitted from the first end of the reflector, the directed beam of light being a strobing light.

The electromechanical signaling device may include a switching device. The electromechanical signaling device may include a pushbutton switch. The electromechanical signaling device may include a rotary switch. The rotary switch may include a switching circuit printed circuit board which includes a plurality of signal output leads, and a rotary contact which is operatively associated with the switching circuit printed circuit board such that the rotary contact selectively engages the switching circuit printed circuit board to electrically connect the rotary contact with one or more of the plurality of signal output leads. The switching circuit printed circuit board further may include one or more pogo pins and a fixed contact facing the rotary contact. Additionally, the switching circuit printed circuit board may include first, second and third signal output leads and first and second pogo pins, such that the first pogo pin is connected to the first input signal lead, the second pogo pin is connected to the second input signal lead, and the fixed contact is connected to the third input signal lead. The rotary contact, selectively, may oscillate with respect to the switching circuit printed circuit board between a first position, a second position and a third position. In the first position, the rotary contact may be spaced from the switching circuit printed circuit board by a first distance and may engage the first pogo pin. In the second position, the rotary contact may be spaced from the switching circuit printed circuit board by a second distance and may engage the first pogo pin and the second pogo pin. In the third position, the rotary contact may engage the first pogo pin, the second pogo pin, and the fixed contact. For example, the first distance may range from approximately 0.5 mm to approximately 2 mm. The first distance may be substantially equal to or greater than 1.5 mm. The second distance may be substantially equal to one half of the first distance.

The electromechanical signaling device may include a selectable output level switching means for bringing at least two conductors into contact with each other in a controlled manner by a user of the flashlight.

DESCRIPTION OF THE DRAWINGS

In the accompanying drawings, which form a part of the specification and are to be read in conjunction therewith and in which like reference numerals (or designations) are used to indicate like parts in the various views.

DESCRIPTION

Figure 1:
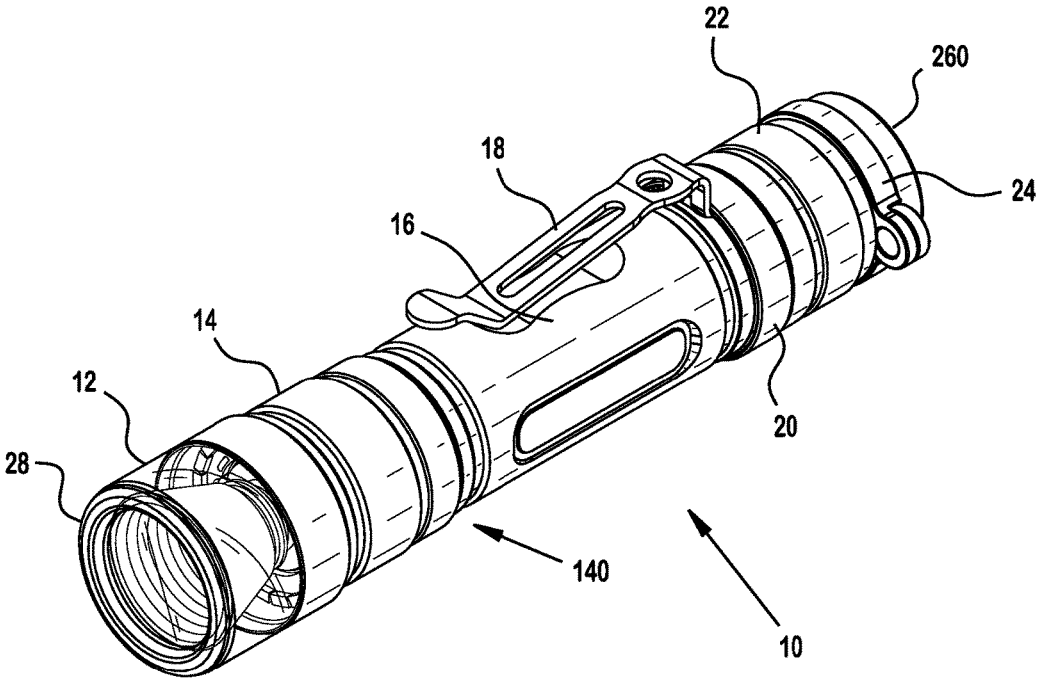
FIG. 1 is a perspective view of an exemplary embodiment of a flashlight in accordance with the present invention.
Figure 2:
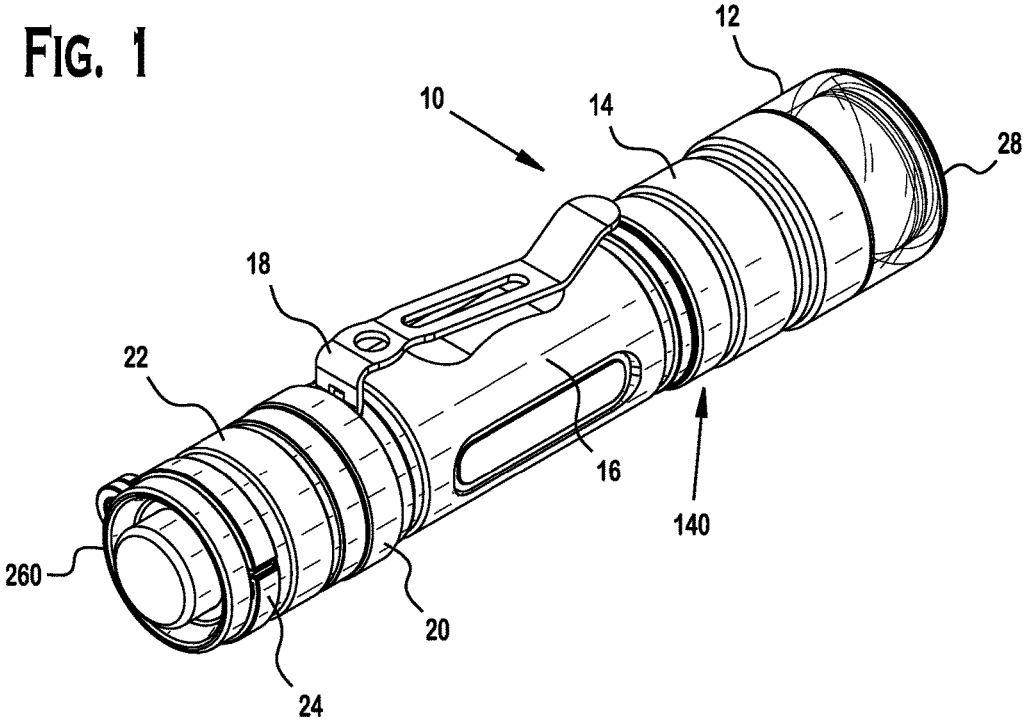
FIG. 2 is a another perspective view of the flashlight of FIG. 1.

FIGS. 1-2 and FIGS. 5-6 show an exemplary embodiment of a flashlight 10 according to the present invention. The flashlight 10 may include a head 12, a forward housing 14, a middle housing 16, a clip 18, a securing ring 20, an aft housing 22, and a lanyard ring 24. The flashlight further may include a forward switch 140.

Figure 3:
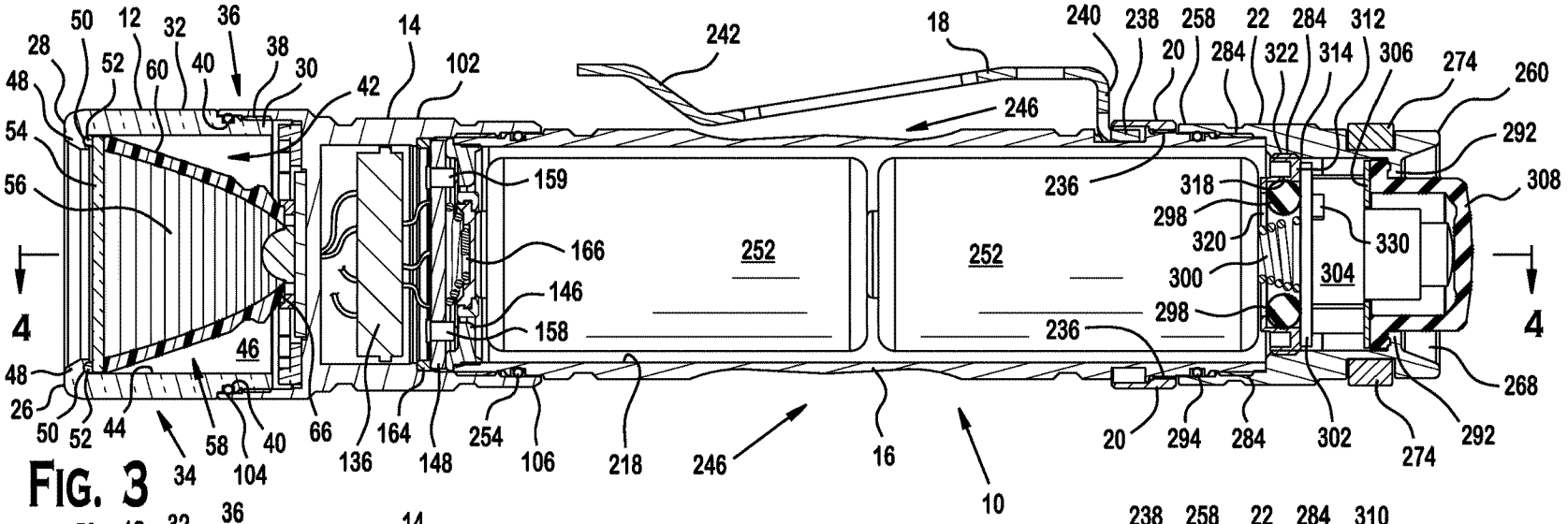
FIG. 3 is a cross-sectional view of the flashlight of FIG. 1.
Figure 4:
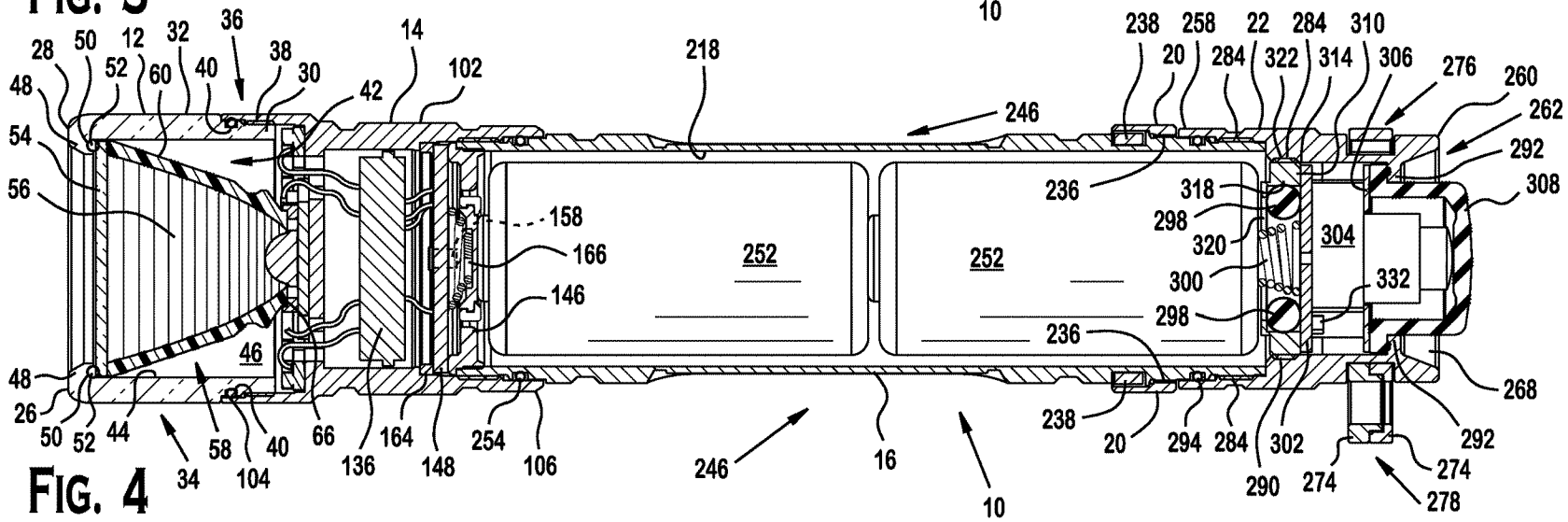
FIG. 4 is a cross-sectional view of the flashlight of FIG. 3, along line 4-4.

Referring to FIGS. 3-4, the head 12 may include a cylindrical member 26 having a distal end portion 28, a proximal end portion 30, and an exterior side wall 32 extending from the distal end portion to the proximal end portion. Although, the exterior side wall may have a first segment 34 of generally uniform exterior cross section, a second segment 36 proximate the distal end portion may have a reduced outer dimension. Further, the second segment of reduced outer dimension may include a screw thread 38 extending from the distal end portion, as well as a circumferential groove 40 disposed between the screw thread and the first segment. The circumferential groove 40 may be configured and dimensioned to receive a sealing element (e.g., an O-ring). Also, the cylindrical member 26 may include an interior passage 42 which extends from the distal end portion to the proximal end portion to form a tubular structure. The interior passage 42 may be bounded by a sidewall 44.

A proximal portion of the inner sidewall 44 may define a generally circular cylindrical chamber 46. However, a distal portion of the inner side 44 wall may taper inwardly to form a rim 48 adjacent the distal opening of the interior passage 42. The rim 48 may include a rearward facing annular shaped wall that abuts the proximal portion. The rim further may include a circumferential groove 50 which may be configured and dimensioned to receive a sealing element (e.g., an elastomeric O-ring).

The head 12 may be formed from light transmitting material. The light transmitting material may be a translucent material, a transparent material, or a combination thereof. For example, the head may be formed from glass, plastic, or polymer materials. In a preferred embodiment, the head may be machined from a tube of polycarbonate (PC) plastic.

Although PC plastic may be a preferred material for the head, any lightweight, high-performance material that possesses a similar balance of toughness, dimensional stability, optical clarity, and high heat resistance may be used. For example, the head may be formed from a polymer material by injection molding or fashioned from shatter resistant glass. The light transmitting material may be colorless or colored. Colored light transmitting material may be, without limitation, yellow, red, green, blue or a mixture of these colors. For example, the light transmitting material may be a red or an orange color which is suitable for use as an emergency light.

A distal opening sealing element 52 may be formed from a waterproof strip of resilient material. The strip may take the form of an O-ring that is configured and dimensioned to be disposed in the circumferential groove 50 of the rim that is located adjacent to the distal opening of the interior passage. The resilient material may be formed, for example, from nitrile rubber or medical grade silicon. Other suitable materials for the application may be used as well.

The flashlight lens 54 may be a clear flat lens, a focusing lens, a collimating lens, or a lens having another configuration (e.g., a compound lens). The lens 54 may be circular in shape, and may be configured and dimensioned to fit snugly within the generally circular cylindrical chamber in the head and to securely seat against the distal opening sealing element. Generally, the lens 54 may be formed from glass (e.g., borosilicate glass), acrylic, polycarbonate, or other suitable materials. The lens further may be shatter-proof and/or scratch resistant. And, the lens may be coated, for example, with an anti-reflective coating.

The reflector 56 may have a concave shape, and may be a parabolic reflector that is configured and dimensioned to project a spot beam through the distal opening of the head. By contrast, the exterior (or outer) surface 58 of the reflector may include a substantially linear segment 60, and thus a portion of the reflector 56 may form a truncated cone.

Figure 14:
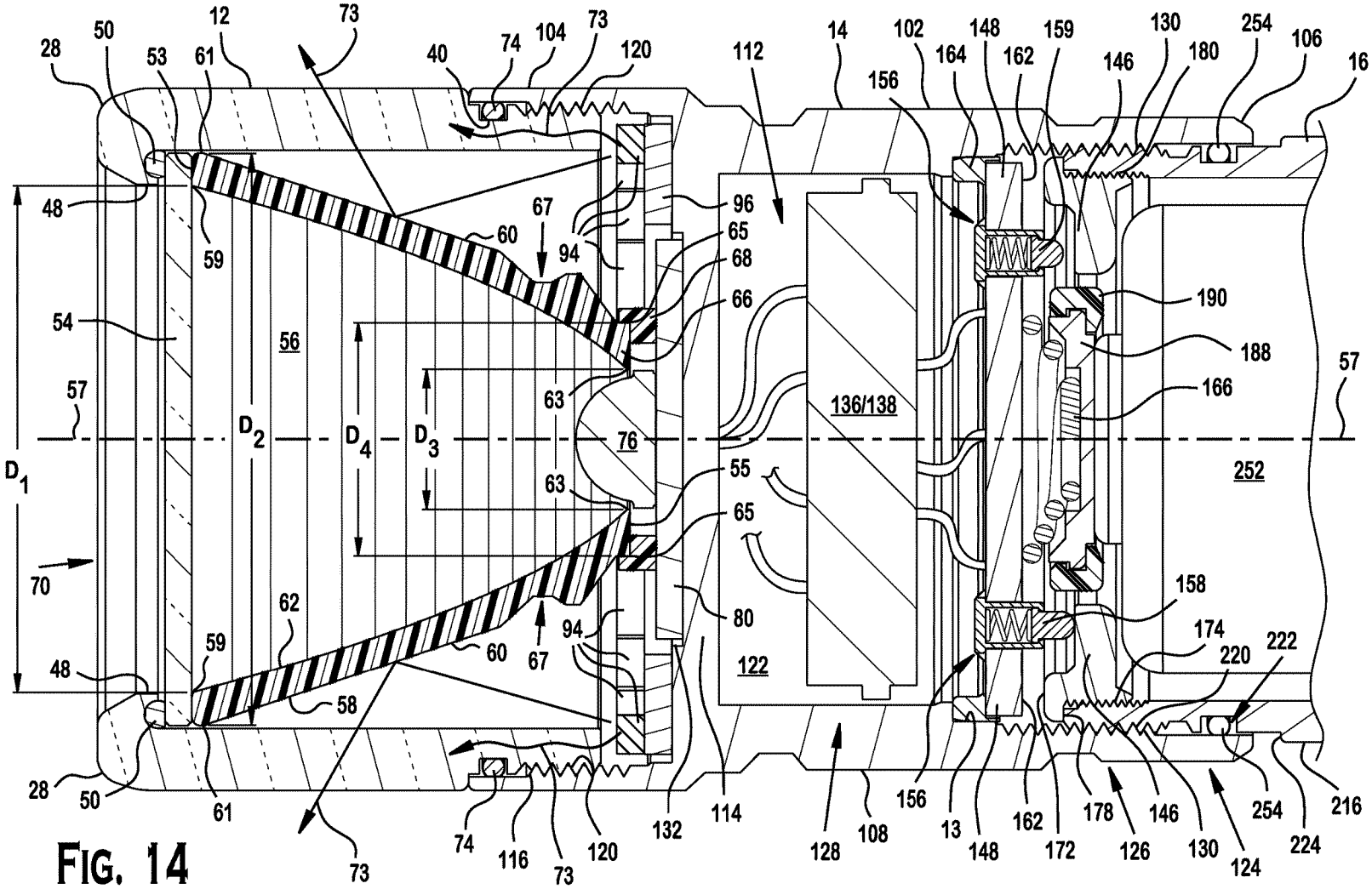
FIG. 14 is a partial enlarged view of the flashlight of FIG. 3 in a fourth operational mode.
Figure 15:
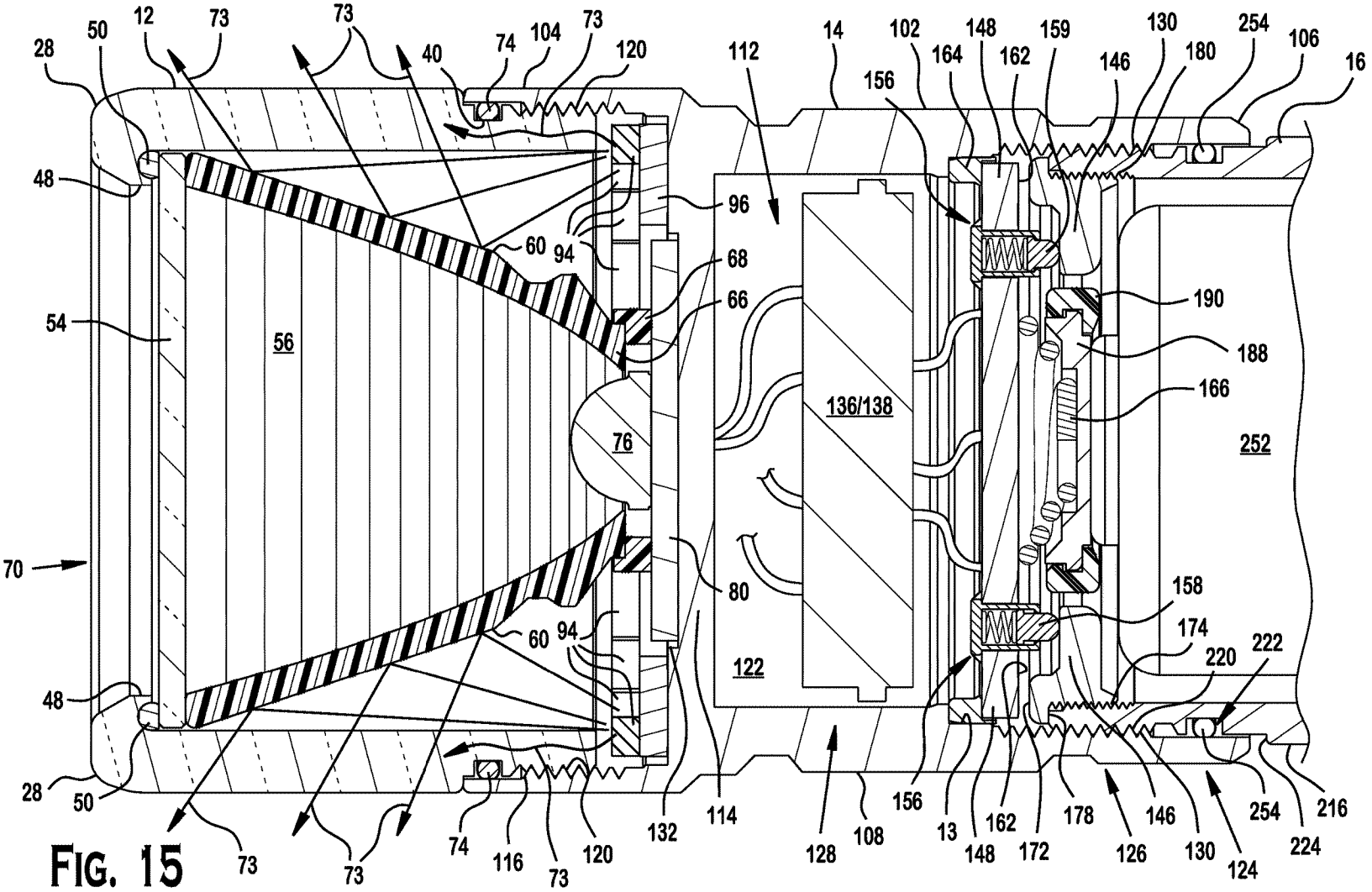
FIG. 15 is a partial enlarged view of the flashlight of FIG. 3 in a fifth operational mode.
Figure 16:
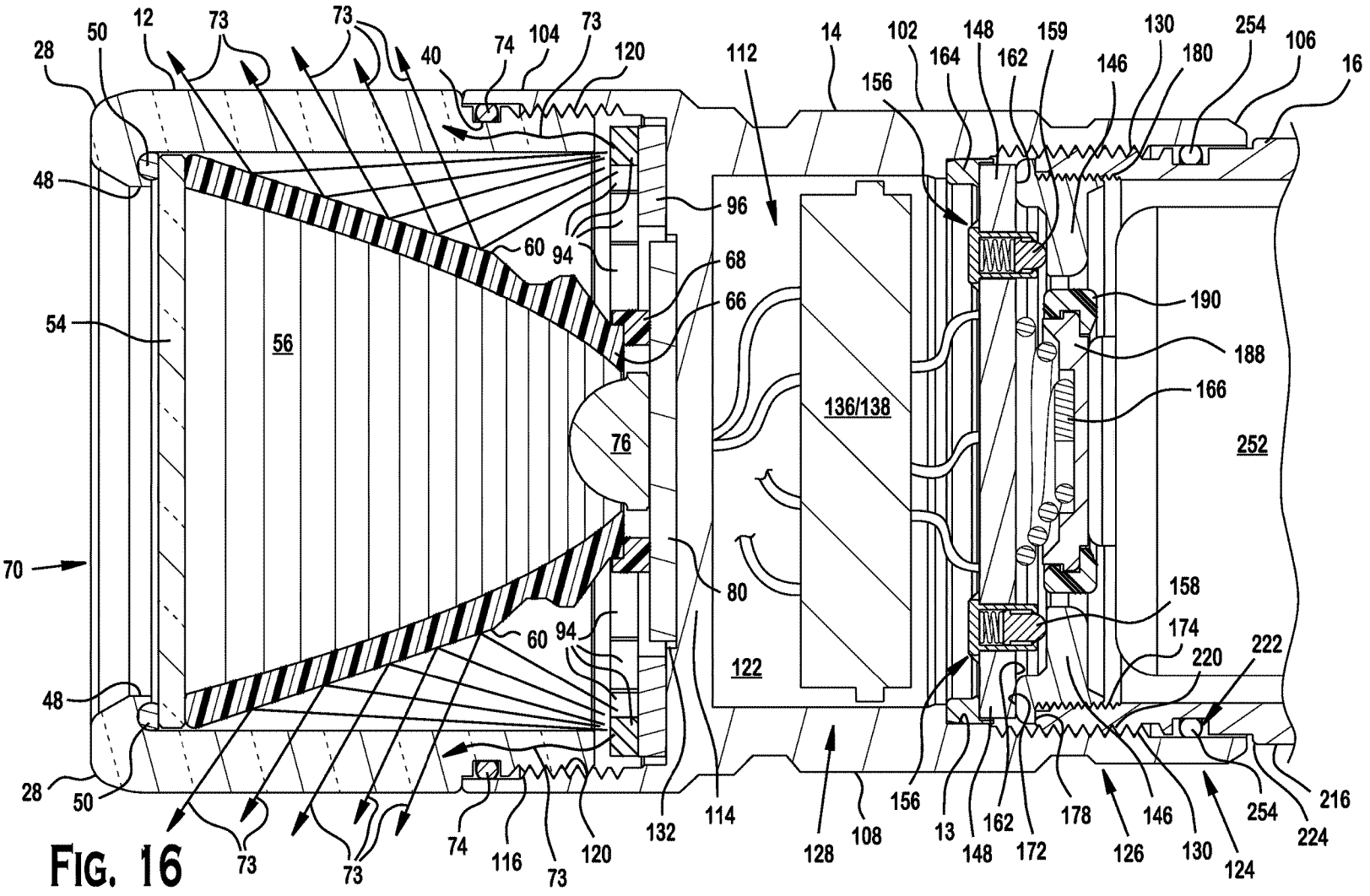
FIG. 16 is a partial view of the flashlight of FIG. 3 in a sixth operational mode.

Referring to FIG. 14, the reflector 56 may include a longitudinal axis 57, as well as a first end 53 which comprises a first rim 59 having a first diameter D1 and a second rim 61 having a second diameter D2. The second diameter D2 may be greater than the first diameter D1. The reflector also may include a second end 55. The second end 55 may be spaced from the first end 53 along the longitudinal axis 57 and may include a third rim 63 having a third diameter D3, and a fourth rim 65 having a fourth diameter D4. The fourth diameter D4 may be greater than the third diameter D3. The reflector further may include an interior surface 62 extending from the first rim 59 to the third rim 63. The interior surface 62 may include a truncated parabolodial shape. The reflector 56 also may include an exterior surface 58 extending from the second rim 61 to the fourth rim 65. The exterior surface 58 may include a first segment 60 that defines a lateral surface of a frustum of a right circular cone.

The exterior surface 58 of the reflector also may include a circumferential groove 67 near the base of the reflector 66. The circumferential groove 67 may be configured and dimensioned to releasably connect with a tool such that the tool may facilitate the application of any coating material(s) on the inner or outer surfaces of the reflector. For instance, the tool may hold, position, or manipulate the reflector during a reflector coating process. Although, the interior (or inner) surface of the reflector preferably may include a smooth coating, other suitable reflector surfaces (e.g., a faceted reflector, a spiral faceted reflector, or a textured reflector may be used as appropriate for the application. Preferably, the exterior surface 58 of the reflector may include a smooth reflective coating. However, the exterior surface of the reflector need not include a reflective coating. Rather, the outer surface 58 of the reflector may remain a raw or untreated surface. Also, the reflector may include a base portion 66 which is configured and dimensioned to seat on a ring that may surround the primary lamp.

A reflector 56 having a different configuration may be used. For example, the interior (or inner surface) 62 of the reflector may include, without limitation, a truncated ellipsoidal shape or a truncated semi-hemispherical shape. Also, the exterior surface (or outer surface) 58 may include, without limitation, a truncated parabolodial shape, a truncated ellipsoidal shape, or a truncated semi-hemispherical shape.

Referring to FIGS. 11-16, a head-forward housing sealing element 74 may be formed from a waterproof strip of resilient material. The strip may take the form of an O-ring, which is configured and dimensioned to be disposed in the circumferential groove on the second segment of the head. The resilient material may be formed, for example, from nitrile rubber or medical grade silicone. Other suitable materials for an application may be used as well.

Figure 7:
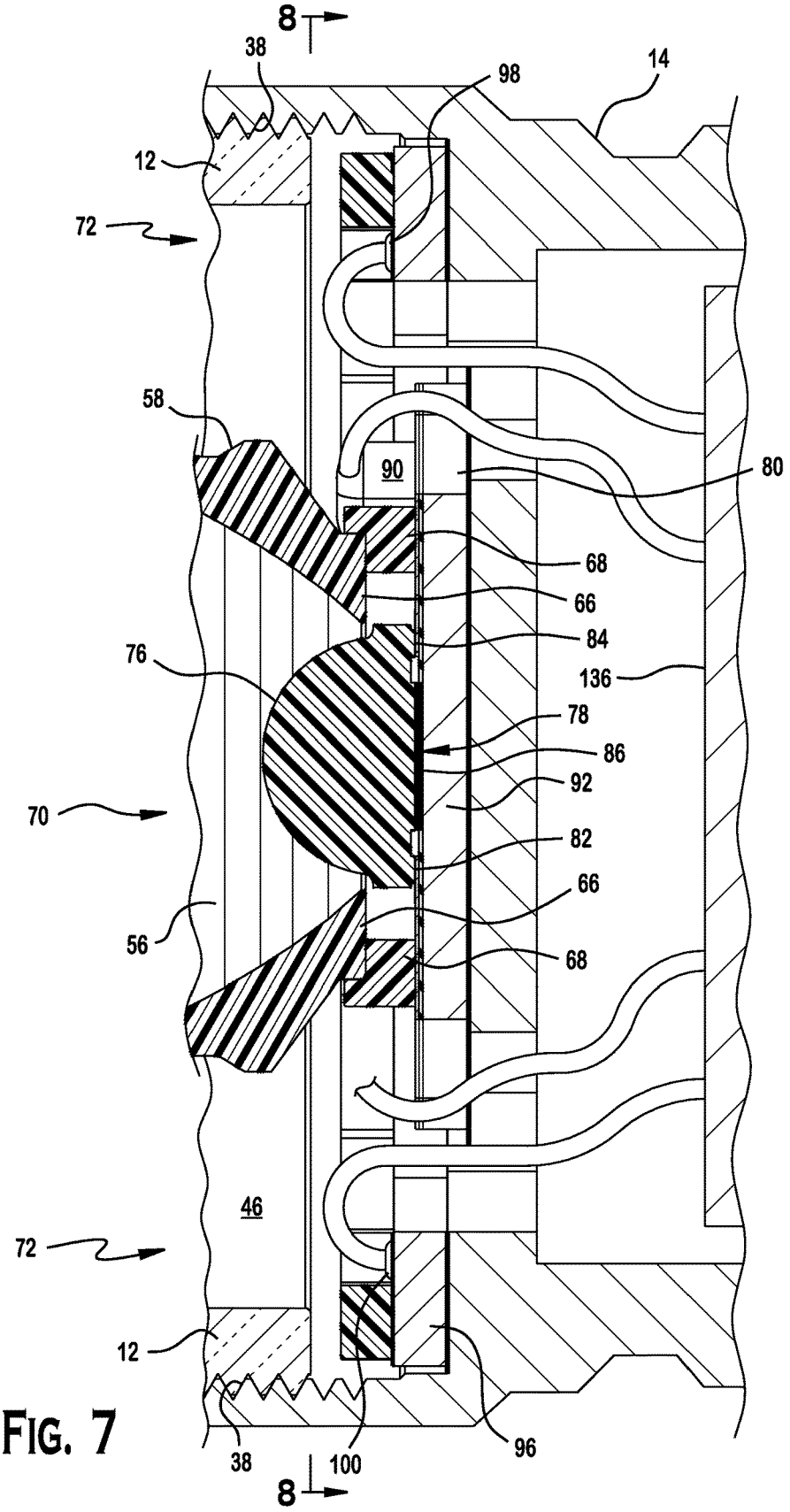
FIG. 7 is a enlarged partial view of the flashlight of FIG. 3.

Referring to FIG. 7, a ring 68 may be configured and dimensioned to receive and support the base 66 of the reflector. Also, the ring may be used to center the inner parabolic surface of the reflector about the primary lamp 70 of the flashlight. The ring 68 further may be used to position the reflector 56 between the primary lamp 70 of the flashlight and a secondary lamp 72. Accordingly, the ring may be configured and dimensioned to provide a stable base for positioning the reflector within the head. Although, the ring 68 may be formed from a plastic or polymer material, other suitable materials such as, glass or ceramic materials, may be used.

Figure 8:
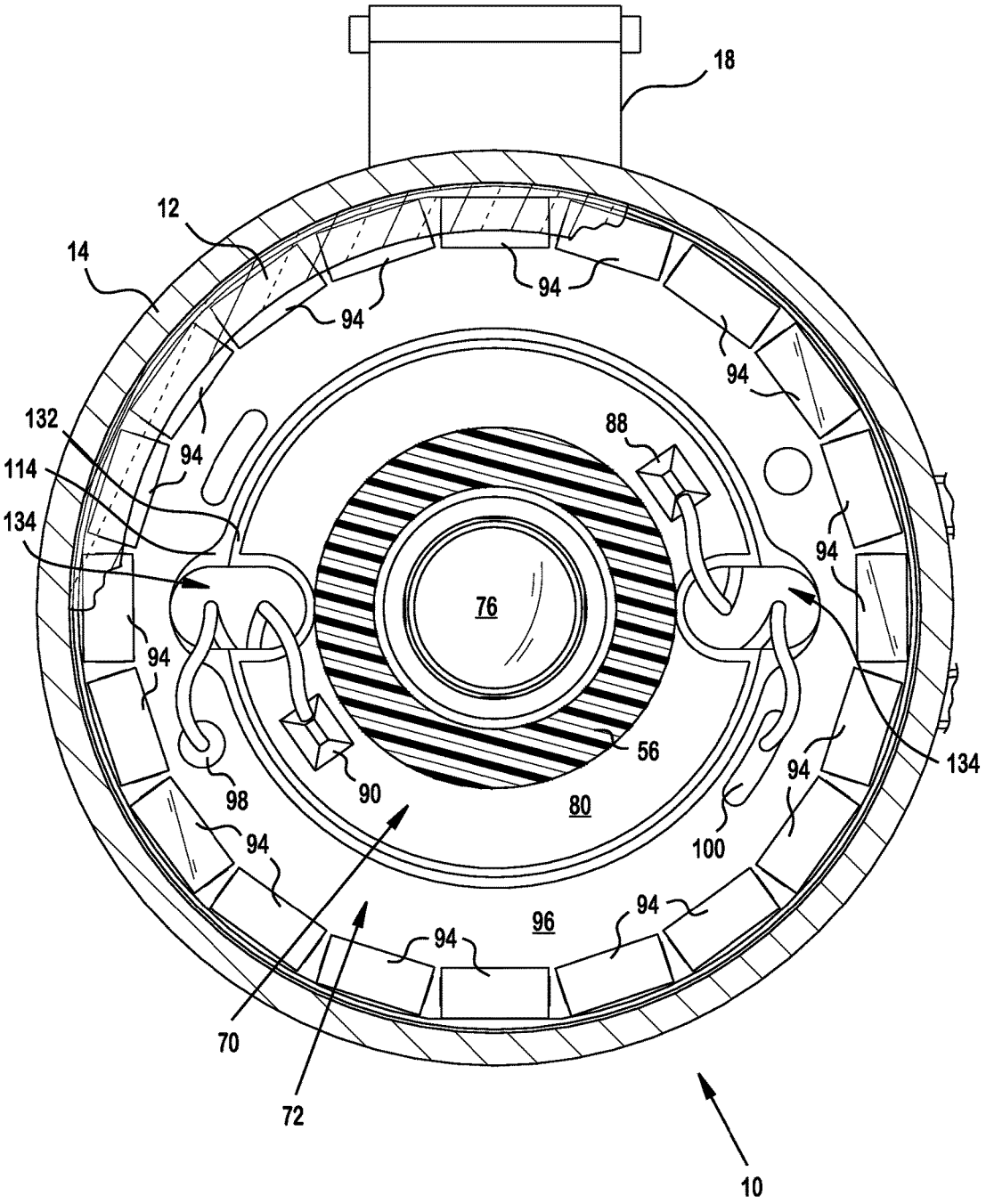
FIG. 8 is a cross-sectional view of the flashlight of FIG. 3, along line 8-8.

Referring to FIG. 7 and FIG. 8, the primary lamp 70 may include a light emitting diode (LED) 76 that is surface mounted (SMT) on to a solder pad 78 (FIG. 7) of a metal core printed circuit board (metal core PCB) 80. For example, a high output single die LED 76 may be soldered on to the solder pad 78 of the metal core PCB 80. The back of the LED (or footprint) may match the shape of the solder pad, such that the anode 82, cathode 84, and heat sink 86 of the LED 76 align and connect with corresponding features on the solder pad 78. The corresponding anode feature on the solder pad 78 may connect electrically to a protruded anode solder pad 88, and the corresponding cathode feature on the solder pad may connect electrically to a protruded cathode solder pad 90. The heat sink 86 of the LED 76 may be situated over the metal core 92 of the printed circuit board.

For example, the primary lamp 70 may include an XLamp® XM-L2 LED manufactured by Cree, Inc. of Durham, N.C., and which may deliver approximately 1198 lumens (lm) at 116 lumens-per-watt (LPW) efficacy at 3 A, 25° C. Product Family Data Sheet, CLD-DS61 REV 4, published by Cree, Inc., which describes the characteristics and mechanical dimensions of the XM-L2 LED, is incorporated herein in its entirety.

Accordingly, the primary lamp 70 may produce a luminous flux ranging from approximately 160 lm to approximately 1200 lm, operating at a lamp current ranging from approximately 100 mA to approximately 3000 mA, and operating at a typical forward voltage ranging from approximately 2.6 V to approximately 3.4 V.

Figure 19:
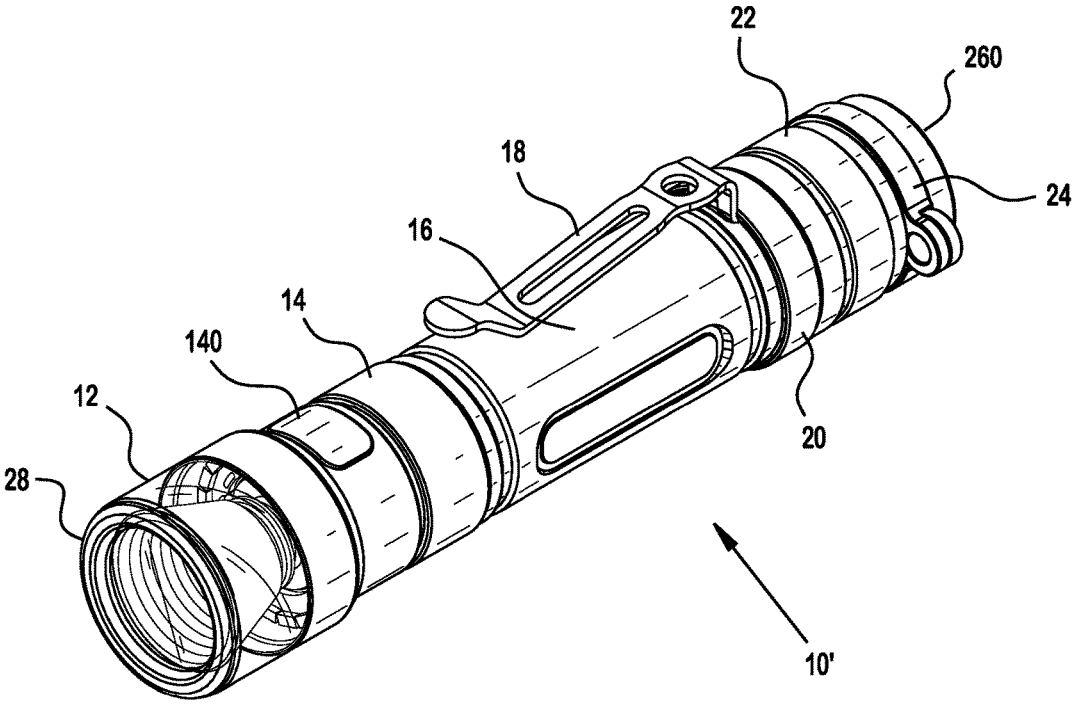
FIG. 19 is a perspective view of another exemplary embodiment of a flashlight in accordance with the present invention.
Figure 20:
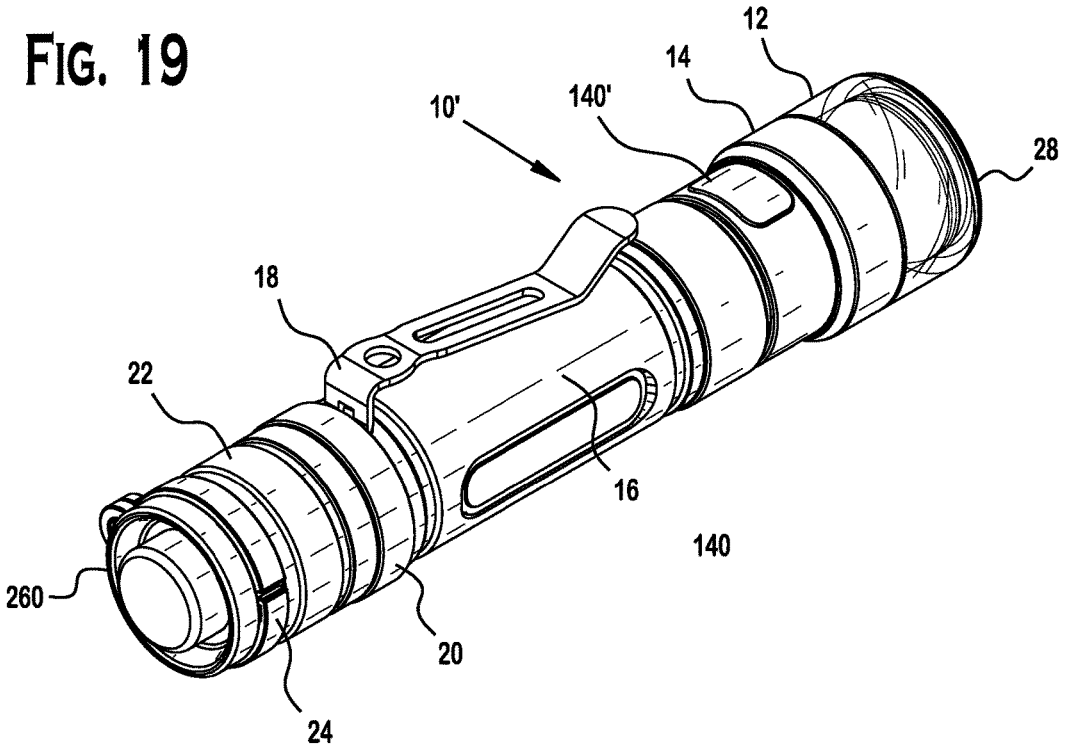
FIG. 20 is another perspective view of the flashlight of FIG. 19.
Figure 21:
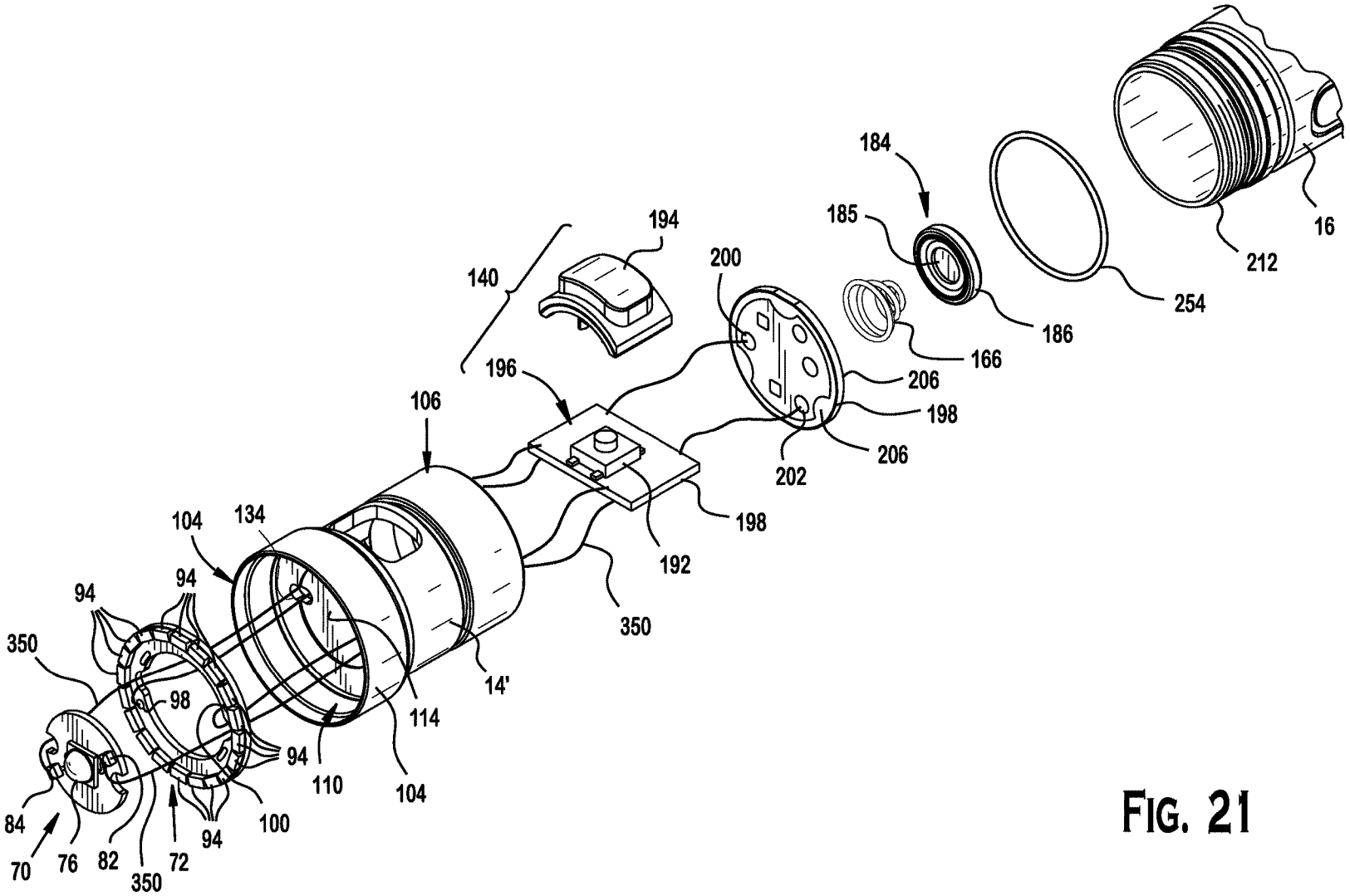
FIG. 21 is a partially exploded view of the forward housing and middle housing of FIG. 19.

In another example, the primary lamp 70 may include an XLamp® MT-G2 P0 LED (5000K, 25 tep) manufactured by Cree, Inc. of Durham, N.C., which may deliver a light output of substantially equal to or greater than 2750 lumens. Product Family Data Sheet, CLD-DS49 REV 2B, published by Cree, Inc., which describes the characteristics and mechanical dimensions of the MT-G2 LED, is incorporated herein in its entirety. In this embodiment, the operating voltage of the primary lamp may range from approximately 5 to approximately 20 volts. Accordingly, the battery type or configuration may vary from the flashlight of FIG. 1 or FIG. 19. For example, six CR123A batteries in series or three NCR-18650 batteries in series may be used to power the flashlight. Thus, the size of the middle housing may be lengthened (or otherwise modified) to accommodate the power supply configuration.

In another example, the primary lamp 70 may include an XLamp® XM-L LED manufactured by Cree, Inc. of Durham, N.C., and which may deliver approximately 1000 lumens at 100 lumens-per-watt efficacy at 3 A, 25° C. Product Family Data Sheet, CLD-DS33 REV 9B, published by Cree, Inc., which describes the characteristics and mechanical dimensions of the XM-L LED, is incorporated herein in its entirety.

In another example, the primary lamp 70 may include an SST-90 P LED manufactured by Luminus Devices, Inc. of Billerica, Mass., and which may deliver approximately 1200 lumens at 3.15 A, 25° C. Product Data Sheet (PDS)-001342 Rev12, published by Luminius Devices, Inc., which describes the characteristics and mechanical dimensions of the SST-90 LED, is incorporated herein in its entirety.

In another example, the primary lamp 70 may include an SBT-90 NB LED manufactured by Luminus Devices, Inc. of Billerica, Mass., and which may deliver approximately 1830 lumens at 9.0 A, 25° C. Product Data Sheet (PDS)-001540 Rev09, published by Luminius Devices, Inc., which describes the characteristics and mechanical dimensions of the SBT-90 LED, is incorporated herein in its entirety.

Although the use of high output LEDs in the primary lamp may be preferred, incandescent bulbs (e.g., halogen bulbs or xenon bulbs) also may be used in a lighting and diffuser apparatus in accordance with the present invention. Generally, flashlights using incandescent light bulbs are known in the related art. For example, U.S. Pat. No. 7,562,996 which is incorporated herein by reference in its entirety discusses a flashlight with a switch housing that is situated between a battery compartment and a reflector which includes a lamp support for an incandescent bulb.

Referring to FIG. 8, the secondary lamp 72 may include an array of low output LEDs 94 that are individually mounted around the outer periphery of an annular PCB 96. The array of LEDs 94 may share a common cathode solder pad 98 and a common anode solder pad 100 located on the secondary lamp PCB. The array of LEDs 94 may include, without limitation, 19 or 20 individual LEDs. For example, each individual LED in the array of LEDs may be a PLCC 3014 LED manufactured by Edison Opto Corporation of New Taipei City, Taiwan. Each LED in the array may deliver a light output of approximately 60 lumens. PLCC Series 3014 0.2W CRI 90 Datasheet, published byEdison Opto Corporation, which describes the characteristics and mechanical dimensions of a PLLC 3014 LED, is incorporated herein in its entirety.

Although the disclosed embodiment has a secondary lamp 72 that is formed from an array of 20 LEDs 94, any suitable number of LEDs may be used to provide a desired distribution of diffused light. For example, an array of 19 LEDs may be used to form the secondary lamp.

The array of LEDs, preferably, may be configured into a continuous ring. In certain embodiments, however, an array of LEDs in a configuration other than a ring may be used. For example, without limitation, the array of LEDs may form a star shape. Preferably, the array of LEDs in the secondary lamp, as shown in FIG. 8, may be positioned under the annular sidewall of the head such that light emitted by the array of LEDs may enter the head without reflecting off the exterior surface of the reflector. Also, the forward housing, reflector and head may be positioned such that light output from the array of LEDs is reflected in a radial and forward manner.

Figure 6:
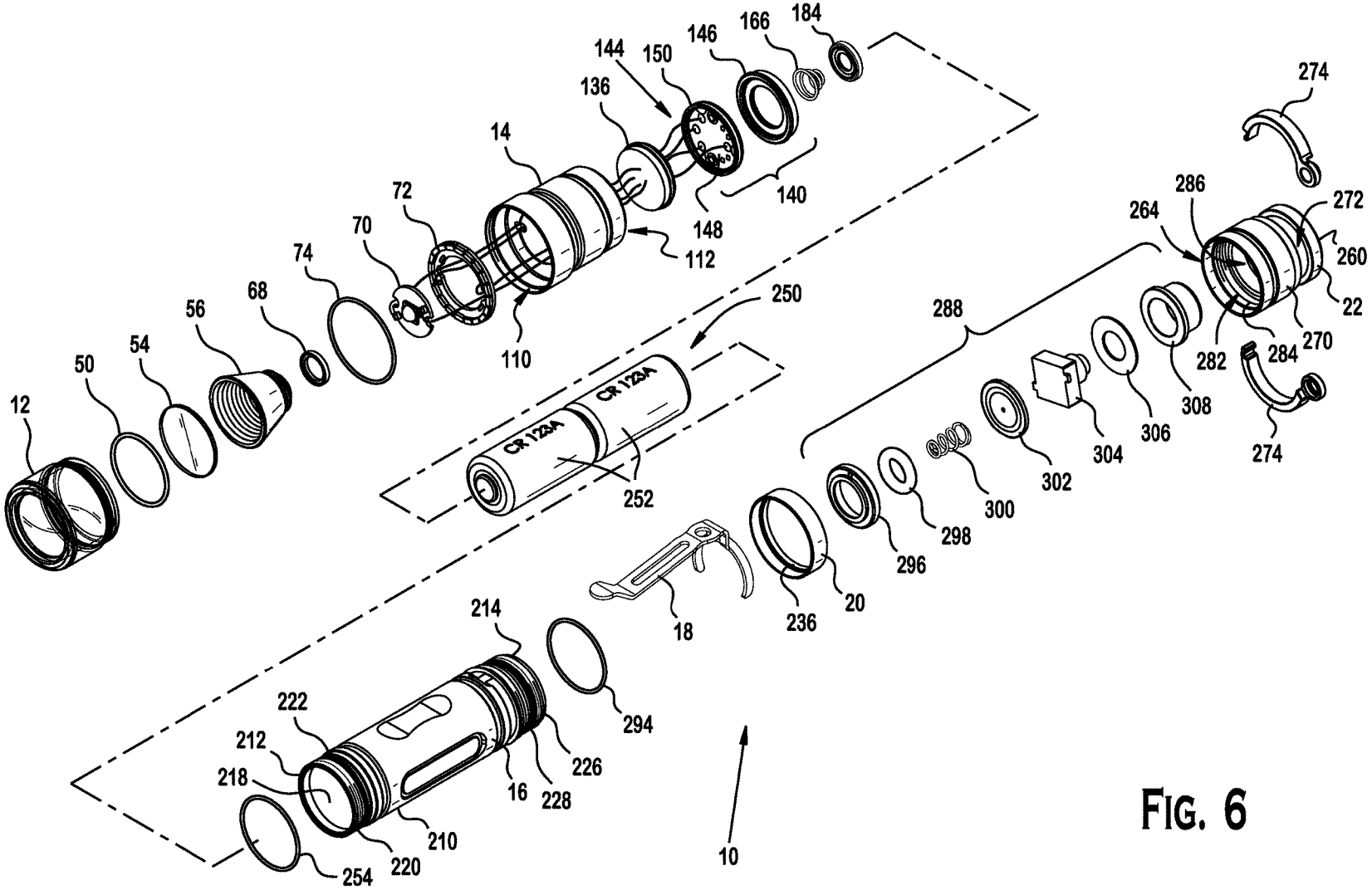
FIG. 6 is an exploded view of the flashlight of FIG. 5, showing parts of the flashlight.
Figure 11:
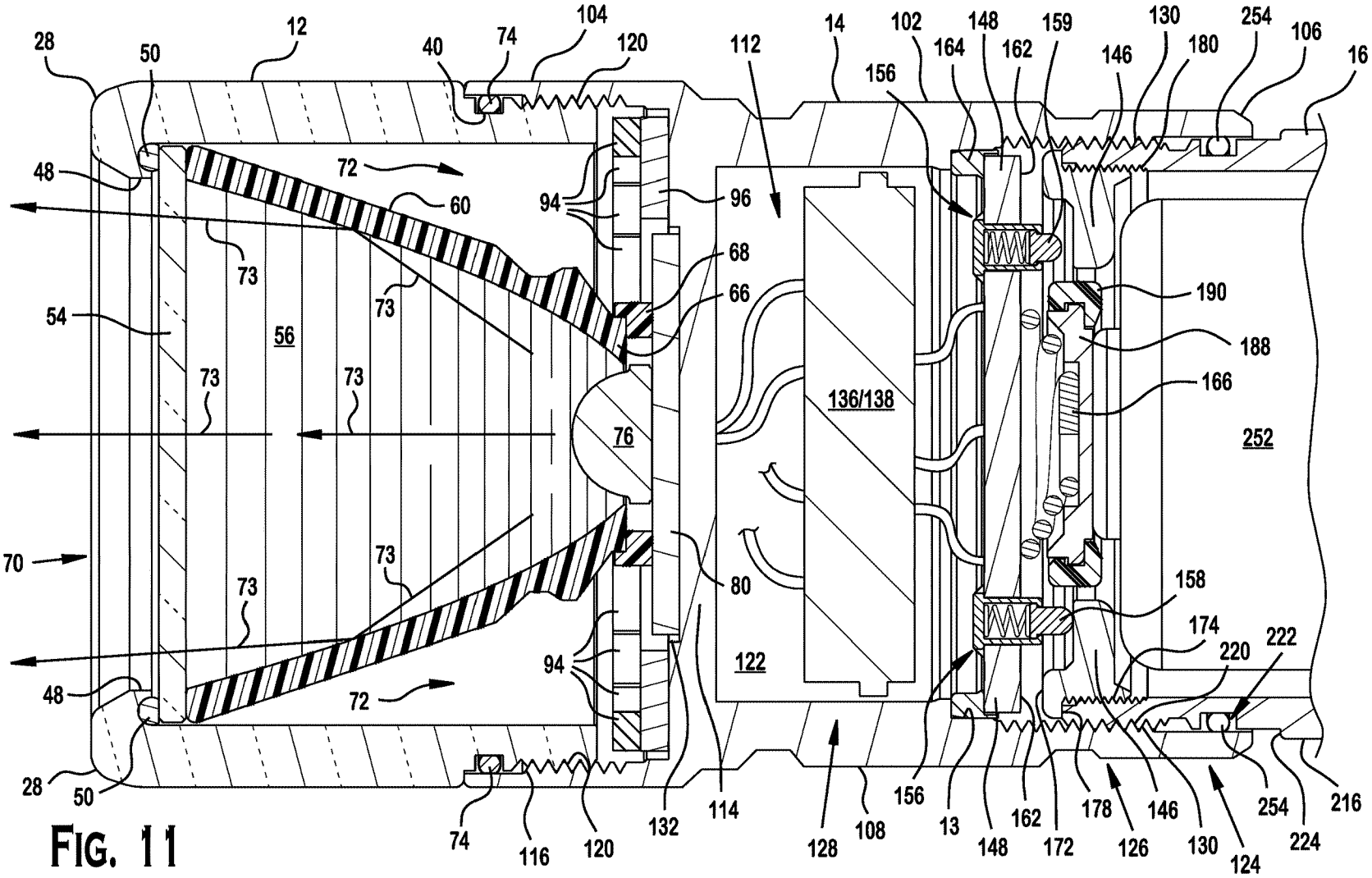
FIG. 11 is a partial enlarged view of the flashlight of FIG. 3 in a first operational mode.
Figure 12:
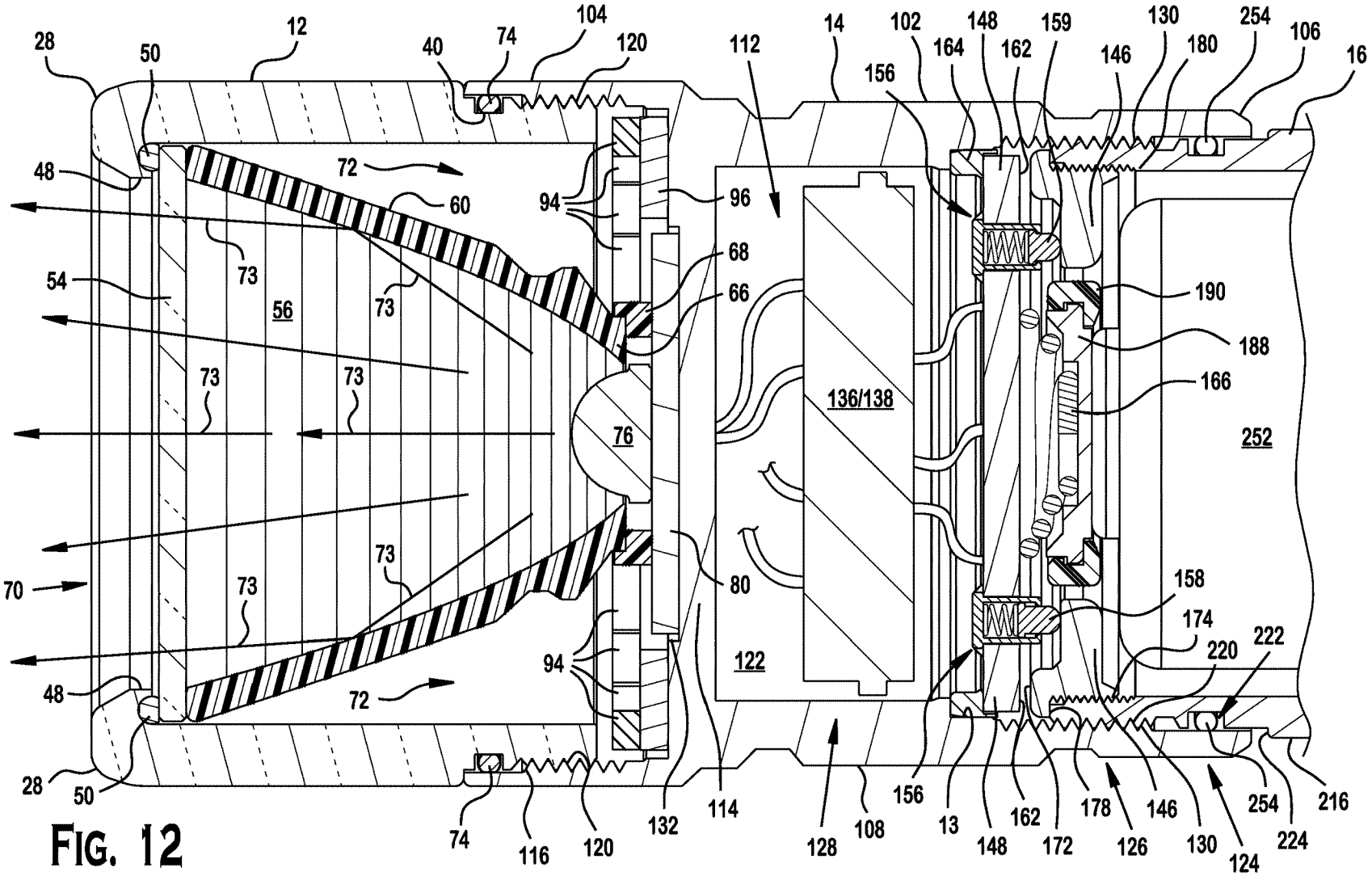
FIG. 12 is a partial enlarged view of the flashlight of FIG. 3 in a second operational mode.
Figure 13:
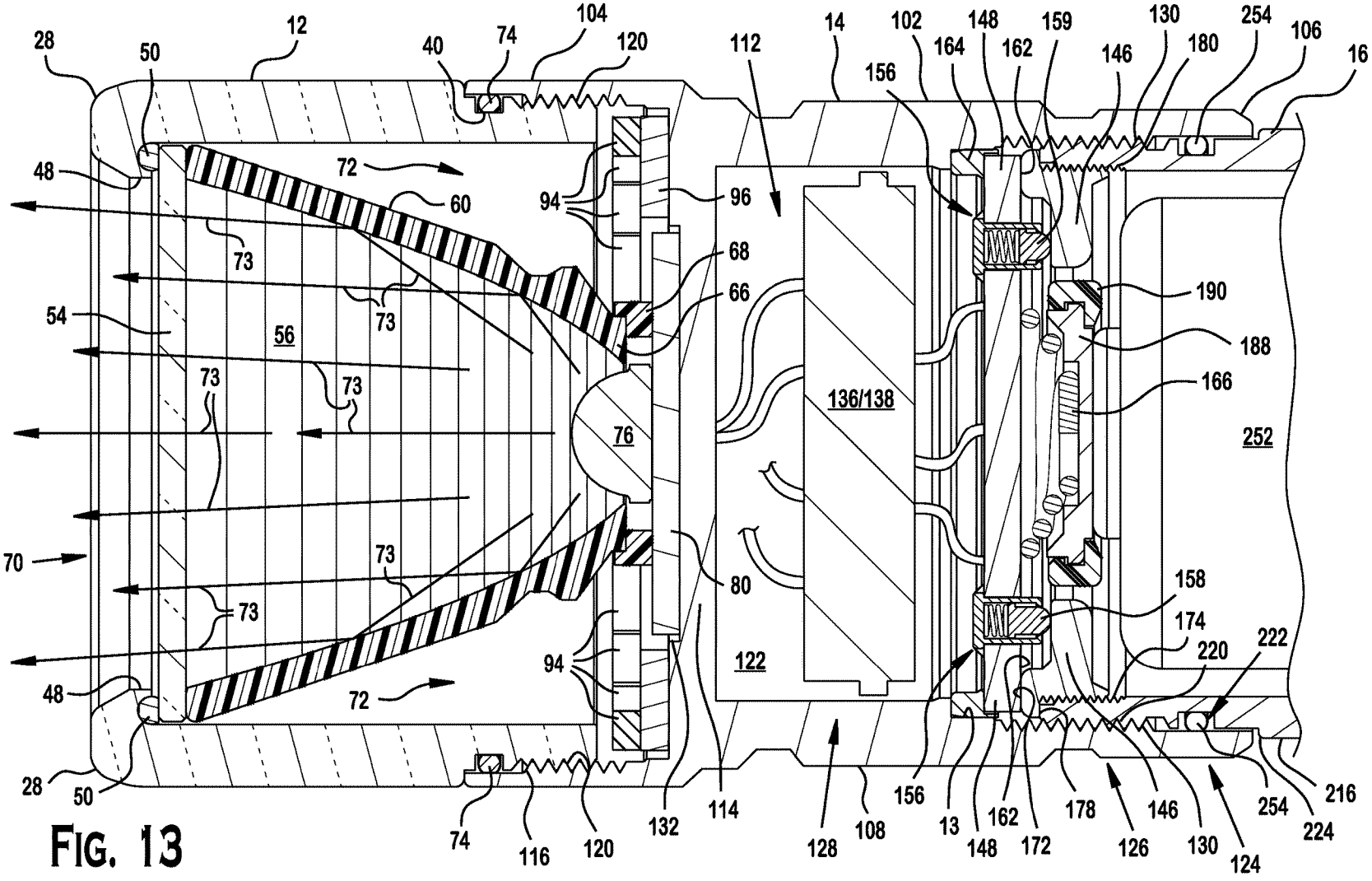
FIG. 13 is a partial enlarged view of the flashlight of FIG. 3 in a third operational mode.

Referring to FIG. 11, the forward housing 14 may include an elongated member 102 that includes a longitudinal axis, a front end portion 104, a rear end portion 106 spaced from the front end portion along the longitudinal axis, and an exterior sidewall 108 that extends from the front end portion to the rear end portion. Referring to FIG. 6, the elongated member further may include an upper chamber 110 extending from the front end portion toward the rear end portion, a lower chamber 112 extending from the rear end portion toward the front end portion, and a partition 114 disposed between the upper chamber and the lower chamber.

Referring to FIGS. 11-16, the upper chamber 110 may be bounded by a front inner sidewall 116, which extends from the front end portion to the partition. The front inner sidewall 116 may include a screw thread 120. The lower chamber 112 may be bounded by a rear inner sidewall, which extends from the rear end portion 106 to the partition 114. The rear inner sidewall 122 may include a first segment 124 having a first inner dimension, a second segment 126 having a second inner dimension less than the first inner dimension, and a third segment 128 having a third inner dimension less than the second inner dimension. The first segment 124 of the lower chamber may include a screw thread 130.

Referring to FIG. 8, the upper chamber facing side of the partition 114 may include a recessed area 132, and the partition may include two holes 134 which extend through the partition from the upper chamber facing side to the lower chamber facing side to connect the upper chamber and the lower chamber. Each hole 134 may be an elongated slot that extends across the recessed area 132 and non-recessed area of the partition.

Referring to FIGS. 11-16, the elongated member 102 may be formed from a metal, an alloy, a polymer, or plastic material. For example, the elongated member 102 may be formed from an aluminum alloy. The elongated member 102 may be anodized to create an anodic layer that renders the surface of the elongated member non-conductive. Localized portions of the anodic layer, however, may be etched to expose an electrically conductive area of the elongated member. For example, the screw thread 130 on the first segment of the lower chamber may be electrically conductive. Also, the inner sidewall of the second segment 126 may be etched to expose another electrically conductive area of the elongated member. The anodic layer may be dyed to impart color to the elongated member. For example, the anodic layer may be dyed to impart the following non-limiting examples of colors to the elongated member: red, blue, green, yellow, and black.

A printed circuit board 136 with a control circuit 138 for regulating current flow to the primary lamp 70 and the secondary lamp 72 may be used to allow a user to control the functionality of the flashlight. The control circuit may include, without limitation, active, passive and electromechanical components, logic circuits, application specific integrated circuits (ASICs), microprocessors, memory, and/or microcontrollers.

For example, in one embodiment, a power circuit may power the primary lamp and the secondary lamp. The output of the power circuit may include two switches (or gates), which block current to the primary lamp or the secondary lamp, respectively. When the two switches (or gates) are open, the primary lamp and the secondary lamp may both turn on but share the current. In a preferred embodiment, the primary lamp and the secondary lamp may each receive about half of the current. The control circuit may regulate the state of the two switches (or gates), as well as the amount of current flowing through the power circuit.

Referring to FIGS. 11-13 and 23, the functionality of the flashlight may include a first operational mode in which the primary lamp produces a relatively focused beam of light that is emitted from the distal opening of the flashlight. The first operational mode may include three operational states, which may be characterized by the luminous radiant power (i.e., overall light output) 73 of the primary lamp. For example, in one state (e.g., FIG. 11), the primary lamp 70 may have a low level of luminous radiant power 73 relative to the other two states. In a second state (e.g., FIG. 12), the primary lamp 70 may have a medium level of luminous radiant power 73 relative to the other two states. And, in a third state (e.g., FIG. 13 and FIG. 23), the primary lamp 70 may have a high level of luminous radiant power 73 relative to the other two states.

Other operational states also may be included. For example, without limitation, in a fourth operational state the primary lamp 70 may have a very high level of luminous radiant power 73 relative to the other states. Also, other operational modes may be included. For example, without limitation, in a third operational mode the primary lamp 70 may generate a strobing light.

Referring to FIGS. 14-16 and 24, the flashlight 10 may include a second operational mode in which the secondary lamp produces a relatively diffuse output of light that is emitted through the exterior side wall of the head. The second operational mode may include three operational states which may be characterized by the luminous radiant power (i.e., overall light output) 73 of the secondary lamp 72. For example, in a first state (e.g., FIG. 14), the secondary lamp may have a low level of luminous radiant power 72 relative to the other two states. In a second state (e.g., FIG. 15), the secondary lamp 72 may have a medium level of luminous radiant power 73 relative to the other two states. And, in a third state (e.g., FIGS. 16 and 24), the secondary lamp 72 may have a high level of luminous radiant power 73 relative to the other two states.

Additionally, the flashlight 10 may include a third operational mode in which the primary lamp produces a relatively focused beam of light that is emitted from the distal opening of the flashlight and the secondary lamp produces a relatively diffuse output of light that is emitted through the exterior side wall of the head. The third operational mode may include three operational states which may be characterized by the combined luminous radiant power (i.e., overall light output) 73 of the primary lamp 70 and the secondary lamp 72. For example, in a first state (not shown), the primary lamp 70 and the secondary lamp 72 may have a low level of combined luminous radiant power 72 relative to the other two states. In a second state (not shown), the primary lamp 70 and the secondary lamp 72 may have a medium level of combined luminous radiant power 73 relative to the other two states. And, in a third state (not shown), the primary lamp 70 and the secondary lamp 72 may have a high level of combined luminous radiant power 73 relative to the other two states.

An exemplary set of light output characteristics and levels for a flashlight including three operational modes and three operating states is provided in Table 1. Although the numerical ranges and target settings provided in Table 1 are preferred for some embodiments, other embodiments may include different numerical ranges and target settings.

TABLE 1

Exemplary Light Output Characteristics and Levels for a Flashlight including Three Operational Modes and Three Operating States

| Mode | State | Primary Lamp | Secondary Lamp | Light Output, Total Luminous Flux (lumens, lm)(a) Lower | Upper | Target Setting |
|---|---|---|---|---|---|---|
| First | Low | On | Off | 1 | 100 | 35 |
| | Medium | On | Off | 101 | 500 | 200 |
| | High | On | Off | 501 | 1500 | 1200 |
| Second | Low | Off | On | 1 | 100 | 10 |
| | Medium | Off | On | 101 | 500 | 150 |
| | High | Off | On | 501 | 1500 | 1200 |
| Third | Low | On | On | 1 | 100 | 10 |
| | Medium | On | On | 101 | 500 | 150 |
| | High | On | On | 501 | 1500 | 1200 |

Notes:
(a)ANSI/NEMA FL1-2009 Standard.

An exemplary set of light output characteristics and levels for a flashlight including two operational modes and six operating states is provided in Table 2. Although the numerical ranges and target settings provided in Table 2 are preferred for some embodiments, other embodiments may include different numerical ranges and target settings.

TABLE 2

Exemplary Light Output Characteristics and Levels for a Flashlight including Two Operational Modes and Six Operating States

| Mode | State | Primary Lamp | Secondary Lamp | Light Output, Total Luminous Flux (lumens, lm)(a) Lower | Upper | Target |
|---|---|---|---|---|---|---|
| First | Low | On | Off | 1 | 100 | 20 |
| | Medium | On | Off | 101 | 500 | 150 |
| | High | On | Off | 501 | 1500 | 1000 |
| | Very High | On | Off | 1501 | 3000 | 2000 |
| Second | Low | Off | On | 1 | 100 | 10 |
| | Medium | Off | On | 101 | 500 | 150 |
| | High | Off | On | 501 | 1500 | 1000 |
| | Very High | Off | On | 1501 | 3000 | 2000 |
| First | Strobe 2 | On | Off | 101 | 500 | 200 |
| | Strobe 1 | On | Off | 501 | 3000 | 2000 |

Notes:
(a)ANSI/NEMA FL1-2009 Standard.

The flashlight 10 may include a forward switch 140 that translates mechanical movement, which is input by a user, into electrical signals that are used by the control circuit to regulate the functionality of the flashlight.

Figure 17:
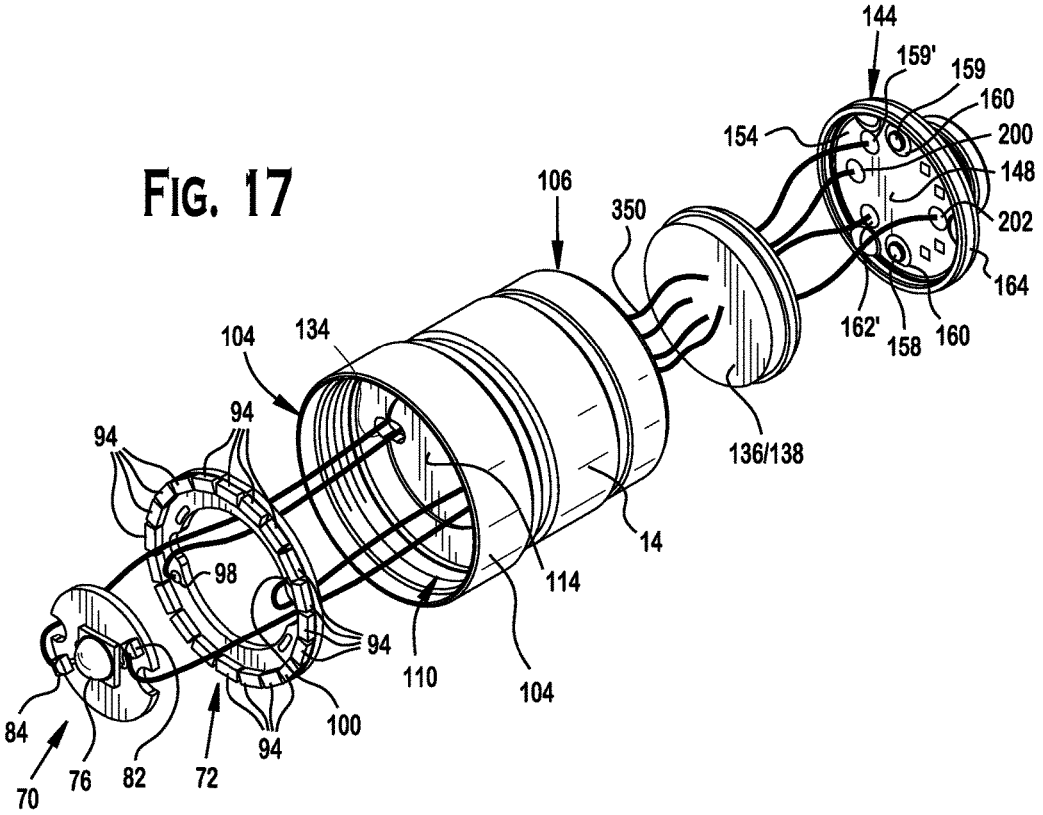
FIG. 17 is a partially exploded view of the forward housing of FIG. 3.
Figure 18:
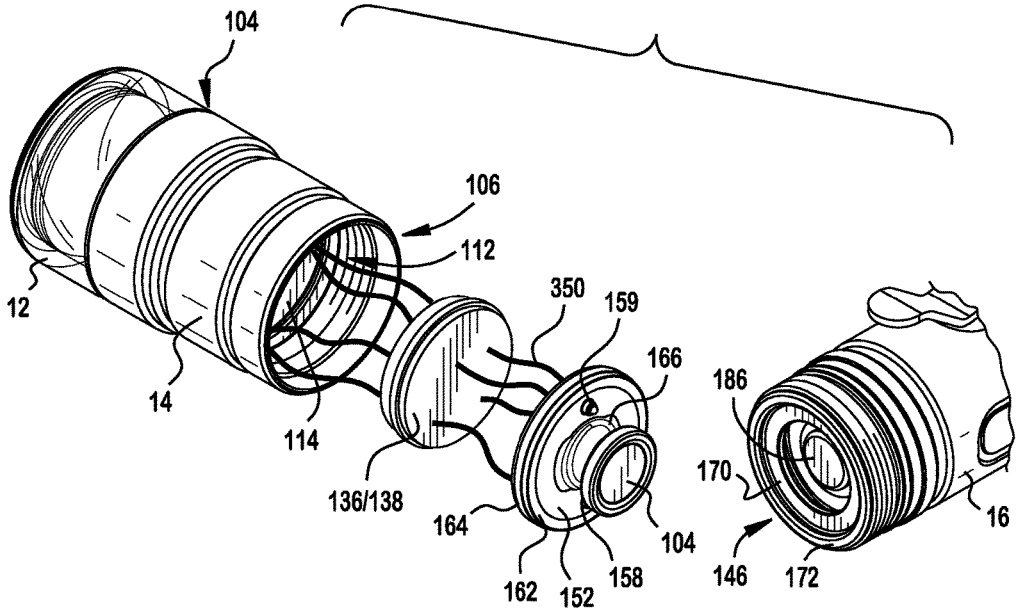
FIG. 18 is a partially exploded view of the forward housing and middle housing of FIG. 3.

Referring to FIG. 6, the forward switch may be a rotary signaling device, which may include a switching circuit 144 and a rotary contact 146. The switching circuit 144 may include a printed circuit board 148 and a peripheral ring 150. As shown in FIGS. 6, 17 and 18, the printed circuit board 146 may have a front side 152 and a back side 154, as well as two holes 156 which extend from the back side of the circuit board to the front side. A pogo pin (or spring loaded contact) 158, 160 may be loaded into a hole 156 such that the spring loaded contact extends beyond the front side of the circuit board. Each pogo pin 158, 160 may be fixed to the circuit board by soldering. Each pogo pin hole 156 may be electrically connected to a solder pad 158', 160' for example, by a wire or circuit board trace. Moreover, a flat contact 162 on the front side of the switching circuit PCB may be electrically connected to a solder pad 162' on the rear side of the switching circuit PCB. Additionally, the peripheral ring 164 may be electrically connected to another solder pad 164' on the rear side of the circuit board. Also, the switching circuit 144 further may include a solder pad or other fixing means on the front side of the printed circuit board that is configured and dimensioned to receive a battery spring (e.g., a conducting spiral compression spring) 166. The solder pad for the battery spring may be electrically connected to a solder pad 168 on the rear side of the printed circuit board.

Although the embodiment of FIG. 1 includes two pogo pin holes 156, other embodiments of the flashlight 10 may include a one, three, or more pogo pin holes 156, pogo pins, and respective circuitry to provide a desired number of control signals for the control circuit. For example, a third pogo pin of shorter length than the short pogo pin 159 may be provided to create a signal device for defining a fourth operating state. By contrast, the embodiment of FIG. 19 may be programmed for a fourth (or more) operating states and modes without modification to the forward switch or control circuit input.

Referring to FIGS. 11, 17 and 18, the rotary contact 146 may include an annular disc 170 which includes a circumferential rim 172. The circumferential rim 172 may include a screw thread 174 and a lip 176 disposed substantially perpendicular to the screw thread. One side of the lip 176 may be configured and dimensioned to seat against an electrical contact 162 on the front side of the switching circuit PCB 148. A second side of the lip 176 may act as a stop 178 for the screw thread. Further, the annular disc 170 and screw thread 174 on the circumferential ring may be configured and dimensioned to be screwed into a mating screw thread 180 located inside the front end portion 104 of the middle housing 16. The interior opening 182 of the annular disc 170 may be configured and dimensioned to provide a clear passage for the battery spring 166 and cap 184, which are connected to the solder pad on the front side 152 of the printed circuit board 148, and which may extend through the interior opening 182 to contact a power supply terminal (e.g., the positive terminal of a battery or battery pack) 186.

The rotary contact 146 may be formed from copper, brass, or other copper alloys, however, any suitably strong and conductive material, such as certain metal or metal alloys, may be used to form the rotary contact. The cap 184 may include a conducting plate 188 for contacting the power supply terminal 186 and a non-conducting exterior portion (or jacket) 190 around the conducting plate to prevent a short circuit from occurring between the rotary contact 146 and the conducting plate 188. The rotary contact may be screwed into the middle housing, and the middle housing may connected to the forward housing with mating screw threads such that the rotary contact may be advanced toward the switching circuit when the middle housing is rotated (or twisted) clockwise with respect to the forward housing. For example, the rotary contact may oscillate a first distance d with respect to the switching circuit PCB when the middle housing is rotated a number of degrees with respect to the forward housing. For example, the first distance d may range, without limitation, from approximately 0.5 mm to 2.0 mm. The number of rotational degrees may range, without limitation, from approximately 25 degrees to approximately 180 degrees. In an exemplary embodiment, the first distance d may be significantly equal to or greater than 1.5 mm and the angle of rotation may be significantly equal to or greater than 140 degrees. Accordingly, in this embodiment the rotary contact may oscillate approximately 1.5 mm when the middle housing is rotated 140 degrees with respect to the forward housing. Additionally, the rotary contact may contact the short pogo pin after traveling a second distance. The second distance may be approximately one-half the first distance d. In an exemplary embodiment the second distance may be approximately 0.8 mm.

Although the foregoing electromechanical signaling device may be preferred, other selectable output level switching systems may be used to regulate operation of the flashlight, provided the other output level switching systems can be incorporated into a portable light and can be constructed with a mechanism that brings at least two conductors into contact with each other in a controlled manner by a user of the portable light. For example, another suitable selectable output level switching system is discussed in U.S. Pat. No. 7,722,209, which is incorporated herein by reference in its entirety.

Referring to FIGS. 19-21 and FIGS. 23-26, the forward switch 140 may be a pushbutton switch 192. The pushbutton switch 192 may be a two-position device that is actuated with a button 194 that is pressed and released. The pushbutton switch 192 may have an internal spring mechanism which returns the button to its "out," or "unpressed," position, for momentary operation. The pushbutton switch 194 may be mounted directly on the control circuit PCB. The control circuit 196 may be wired to the solder pads of the primary lamp 70 and the secondary lamp 72 as described above. Additionally, the control circuit maybe wired to a stationary PCB that includes power supply terminals. For example, the stationary PCB may include a solder pad on the front side that is configured and dimensioned to receive a battery spring (e.g., a conducting spiral compression spring), as well as a circumferential metal trace on the opposite side of the PCB which is configured and dimensioned to contact an electrically conducting and grounded portion of the forward housing.

Figure 5:
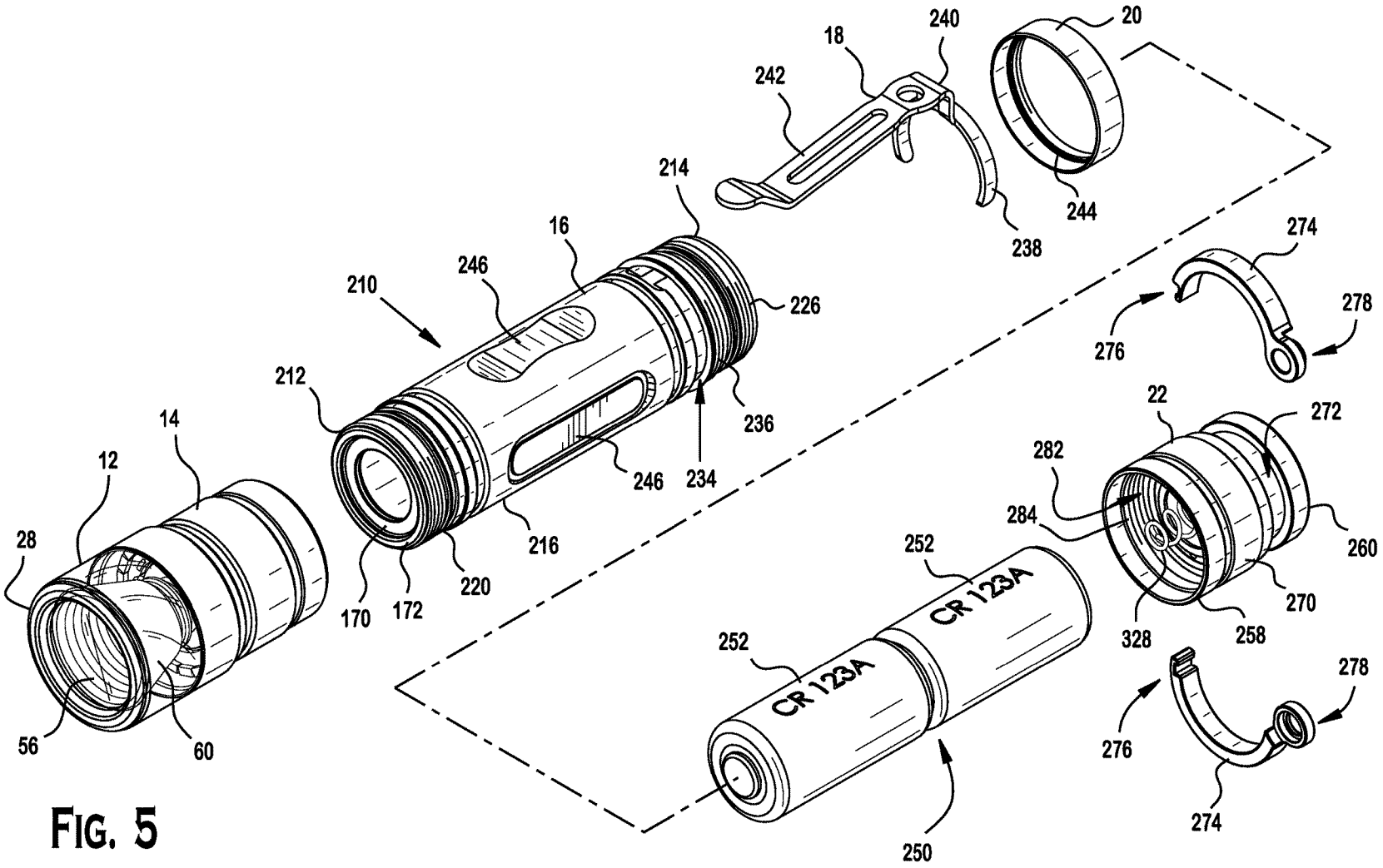
FIG. 5 is a partially exploded view of the flashlight of FIG. 1, showing components of the flashlight.

Referring to FIG. 5, the middle housing 16 may be a tubular member 210 including a front end portion 212 and a rear end portion 214. The tubular member may include an exterior surface 216 that extends from the front end portion 212 to the rear end portion 214. Additionally, the tubular member may include an interior surface 218 that extends from the front end portion to the rear end portion. Referring to FIG. 11, the exterior surface 216 may include a screw thread 220, a circumferential recess 222 and a circumferential projection 224 adjacent the front end portion, which may be configured and adapted to connect with features 106, 130 on the first and second segments 124, 126 of the forward housing to secure the middle housing to the forward housing. Referring to FIG. 5, the exterior surface 216 may include a screw thread 236, a circumferential recess 228 and a circumferential projection 230 adjacent the rear end portion 214, which may be configured and adapted to connect with features 284 on the aft housing to secure the middle housing to the aft housing. The rear end portion 214 further may include a circumferential slot 234 and another screw thread 236 adjacent the circumferential slot. The circumferential slot 234 may be configured and dimensioned to receive an anchor 238 for a clip 18 and the adjacent screw thread 236 may be configured and dimensioned to mate with the securing ring 20.

The clip 18 may include a post 240 that extends from the anchor, as well as a cantilever 242 that extends from the post. Additionally, the securing ring 20 may include an internal screw thread 244 that is configured and dimensioned to mate with the screw thread 236 adjacent the circumferential slot. As shown in FIG. 3 and FIG. 4, the securing ring 20 may lock the anchor 238 within the circumferential slot 234 when the internal screw thread 244 and the screw thread 236 adjacent the circumferential slot are mated.

Referring to FIG. 5, the exterior surface 216 further may include one or more surface features 246 which may be formed from raised or lowered areas of the exterior surface. The surface features 246 may be configured and dimensioned to provide an ergonomic benefit to a user or to enhance a user's ability to secure the flashlight to a mechanical mounting system. The interior surface 218 (FIGS. 3-4) may define a compartment 248 for storing a power supply 250 for the flashlight. For example, the compartment may be configured and dimensioned to store two batteries 252 in series. Preferably, the compartment may be configured and dimensioned to store two CR123A lithium cylindrical batteries in series. More preferably, the compartment also may be configured and dimensioned to store two rechargeable NCR 18650 cylindrical batteries in series. Although, the compartment 248 may be sized for the foregoing battery sizes and configurations, the compartment in other embodiments of the flashlight may be configured and dimensioned for other battery configurations or types, provided the other battery configurations or types provide sufficient performance characteristics for those embodiments.

The tubular member 210 may be formed from a metal, an alloy, a polymer, or plastic material. For example, the elongated member may be formed from an aluminum alloy. The tubular member 210 may be anodized to create an anodic layer that renders the surface of the elongated member non-conductive. Localized portions of the anodic layer, however, may be etched to expose an electrically conductive area of the elongated member. For example, screw threads 220, 226 on the exterior surface of the tubular member, which are adjacent to the front end portion and the rear end portion may be electrically conductive. Additionally, the anodic layer may be dyed to impart color to the elongated member. For example, the anodic layer may be dyed to impart the following non-limiting examples of colors to the elongated member: red, blue, green, yellow, and black.

The power supply 250 for the flashlight may be located in the middle housing. The power supply 250 may include one or more batteries 252 stored in the compartment 248 of the middle housing. For example, two CR123A lithium cylindrical batteries may be placed in series in the compartment to power the flashlight. In another example, two rechargeable NCR 18650 cylindrical batteries may be placed in series in the compartment to power the flashlight.

Referring to FIGS. 3-4, the forward housing-middle housing sealing element 254 may be formed from a waterproof strip of resilient material. The strip may take the form of an O-ring, which is configured and dimensioned to be disposed in the circumferential recess adjacent the front end portion of the tubular member. The resilient material may be formed, for example, from nitrile rubber or medical grade silicone. Other suitable materials for the application may be used as well.

The aft housing 22 may include a casing 256 which includes a front end portion 258, a rear end portion 260 and an interior passage 262 which extends from a front opening 264 located on the front end portion of the aft housing to a rear opening 262 located on the rear end portion of the aft housing. The interior passage 262 may be bounded by an interior sidewall 268 that extends from the front end opening to the rear end opening. Referring to FIG. 5, the casing further may include an exterior surface 270 that extends from the front end portion to the rear end portion.

The exterior surface 270 of the aft housing further may include a circumferential notch 272 adjacent the rear end portion. The circumferential notch 272 may be configured and dimensioned to receive a lanyard ring 24. The lanyard ring 24 may be formed from a pair of lanyard ring segments 274. Each lanyard ring segment 274 may include a hook 276 and an eyelet 278. The hooks 276 of each respective lanyard ring segment 274 may interlock with each other and each respective eyelet 278 may form a press fit connection that mates with each other to form the lanyard ring.

The exterior surface 270 of the aft housing further may include one or more surface features which may be formed from raised or lowered areas of the exterior surface. The surface features may be configured and dimensioned to provide an ergonomic benefit to a user or to enhance a user's ability to secure the flashlight to a mechanical mounting system.

Referring to FIG. 6, the interior sidewall of the aft housing may define a socket 282 abutting the front opening 261 that is configured and dimensioned to securely receive the rear end portion 214 of the middle housing. A portion of the socket 282 may include a screw thread 284 which is configured and dimensioned to mate with the screw thread 226 located adjacent to the rear end portion 214 of the middle housing 16. Also, a portion of the interior sidewall 268 of the aft housing may form a receptacle 286 for retaining a power switch assembly 288 for the flashlight. As shown in FIG. 4, the receptacle 286 may be located between the socket 282 and the rear end portion 260 of the aft housing. The receptacle may include a screw thread 290 adjacent to the socket, as well as a circumferential projection 292 adjacent to the rear end portion of the aft housing.

The middle housing-aft housing sealing element 294 may be formed from a waterproof strip of resilient material. The strip may take the form of an O-ring, which is configured and dimensioned to be disposed in the circumferential recess adjacent the rear end portion of the tubular member. The resilient material may be formed, for example, from nitrile rubber or medical grade silicone. Other suitable materials for the application may be used as well.

Referring to FIG. 6, the power switch assembly 288 may be operated by a user to selectively energize or de-energize the flashlight. The power switch assembly 288 may include a retaining ring 296, an O-ring 298, a battery spring 300, a power switch PCB 302, a push button switch 304, a washer 306, and a resilient cover 308.

Referring to FIGS. 3-4, the retaining ring 296 may include a circular band 310 that includes an upper surface 312, an outer surface 314, a lower surface 316, and an inner surface 318, as well as an annular base 320 adjoining the lower surface. The circular band further may include a circumferential screw thread on the outer surface that is configured and dimensioned to mate with the screw thread adjacent the socket of the aft housing.

The inner sidewall 318 and the annular base 320 may define an internal space 324 that is configured and dimensioned to receive an O-ring 298 while allowing a battery spring 300 to extend through the annular base 320 and circular band 310 without contacting the retaining ring 296. The retaining ring 296 may be formed from a conductive material, such as a metal or metal alloy including, without limitation, sheet metal, steel, stainless steel, and aluminum alloy.

The O-ring, by contrast, may be an insulator that is configured and dimensioned to be received in the internal space 324 of the retaining ring such that the inner surface of the O-ring 298 circumscribes the battery spring 300 to prevent the battery spring 300 from contacting the retaining ring 296. The battery spring 300 may be a metal wire spiral compression spring. The battery spring may be soldered to a contact on the bottom side of the power switch PCB 302.

A pushbutton switch 304 may be mounted on the opposite side of the power switch PCB 302. The pushbutton switch 304 may be a two-position device that is actuated with a button that is pressed and released. The pushbutton switch may have an internal spring mechanism which returns the button to its "out," or "unpressed," position, for momentary operation. One terminal 330 of the pushbutton switch may be electrically connected to the battery spring contact 304. The other terminal 332 of the pushbutton switch may be electrically connected to a second contact 336 on the bottom side of the power switch PCB. The second contact (or a trace that is electrically connected to the second contact) may be positioned to contact the upper surface 312 of the retaining ring 296.

A rigid washer 306 may be placed over the pushbutton switch 304 to provide a bearing surface 338 for the resilient cover 308, which may be positioned in the rear opening 266 and seated on the circumferential projection 292 of the aft housing. The resilient cover 308 may be made from silicone.

Figure 9:
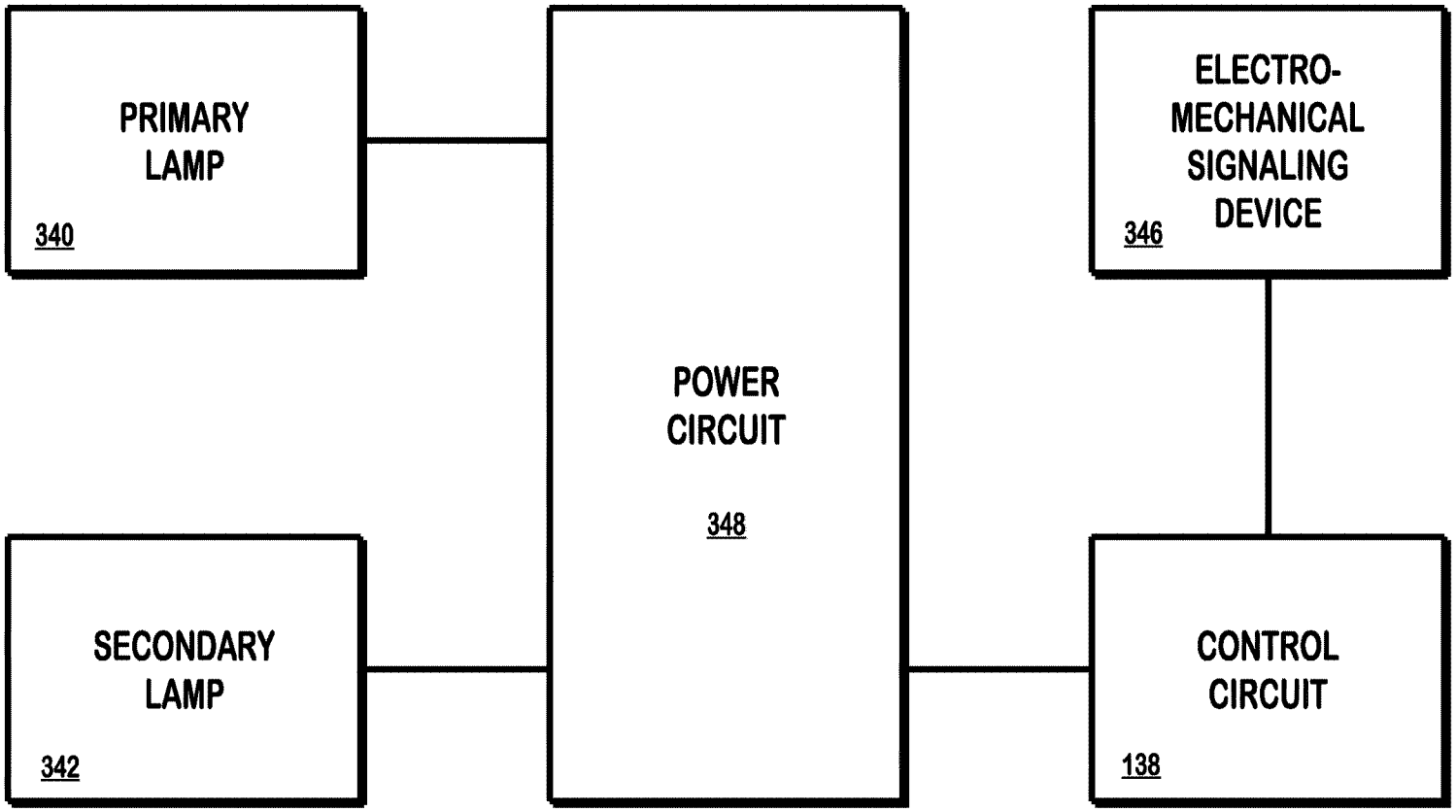
FIG. 9 is an exemplary block diagram of the flashlight of FIG. 1 and FIG. 19.

Referring to FIG. 9, an exemplary flashlight electrical system 360 may include a primary lamp 340, a secondary lamp 342, a control circuit 138, an electromechanical signaling device 346, and a power circuit 348. The electromechanical signaling device 346 may translate mechanical movement, which is input by a user, into electrical signals that may be used by the control circuit 138 to affect the functionality of the flashlight. The control circuit 138 may regulate electrical current flow to the primary lamp 340 and the secondary lamp 342 based on one or more electrical signals from the electromechanical signaling device 346 to control the functionality of the flashlight. The power circuit 348 may provide a source of electricity for the flashlight and may regulate and distribute electrical current to the other components.

Figure 10:
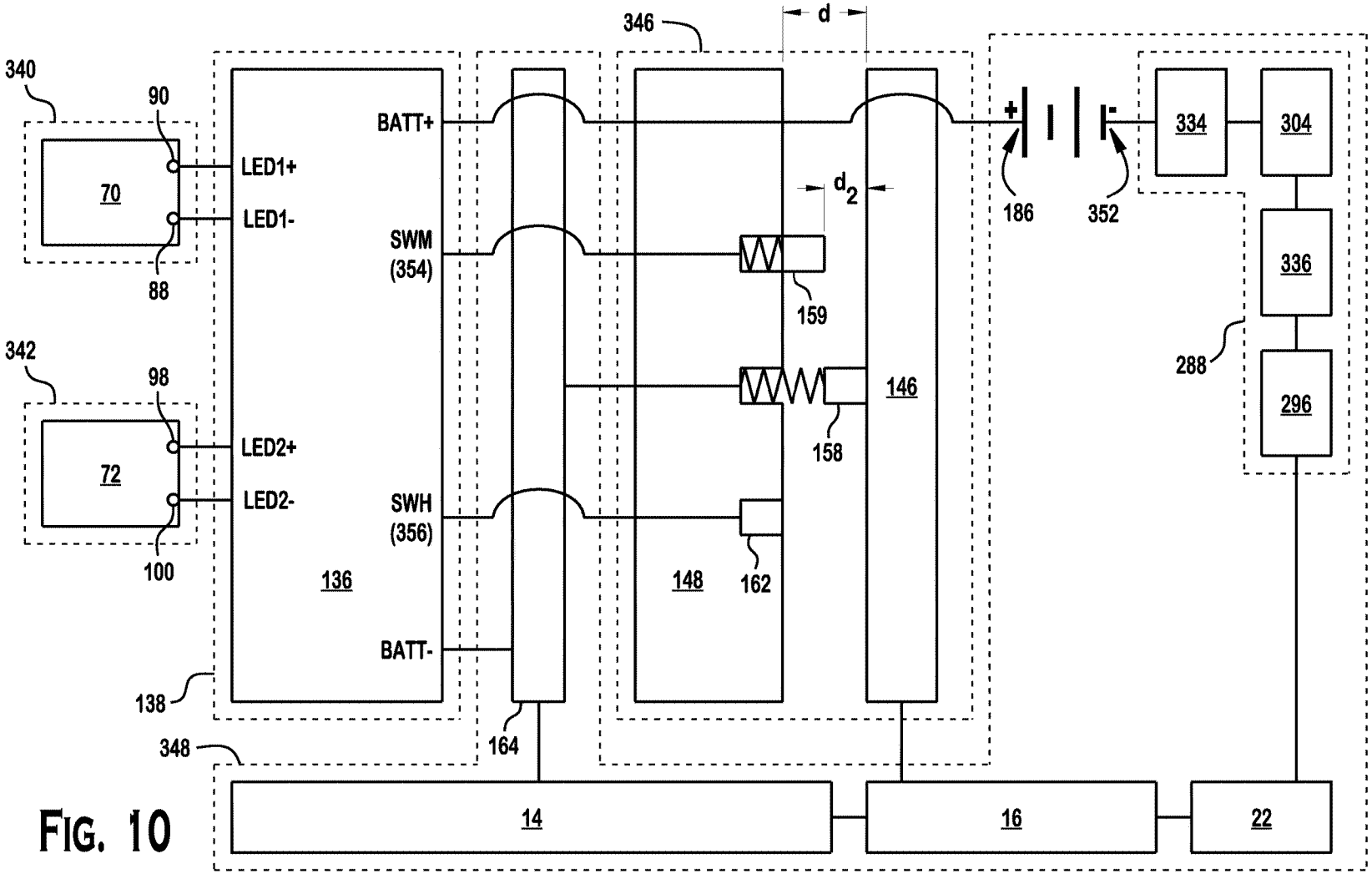
FIG. 10 is a schematic diagram of an exemplary electrical system of the flashlight of FIG. 1.

Referring to FIG. 10, the primary lamp terminals 88, 90 may be connected by wires 350 to the control circuit. Similarly, the secondary lamp terminals 98, 100 may be connected by wires to the control circuit 138. Additionally, the control circuit 138 may be connected to the positive terminal 186 of the power supply. The control circuit 138 may be selectively connected to the negative terminal 352 of the power supply through the power switch assembly 288, aft housing 22, middle housing 16, and peripheral ring 164.

The long pogo pin 158 may be grounded to the negative terminal 352 through the power switch assembly 228, aft housing 22, middle housing 18, and rotary contact 146. The short pogo pin 159 may be connected to the "medium power" signal input 354 of the control circuit. The flat contact 162 on the front side of the switching circuit PCB may be connected to the "high power" signal input 356 of the control circuit.

In use, the power switch 304 may be used to selectively energize the power circuit 348, and the control circuit 138 may receive a first input signal from the short pogo pin 159 and a second input signal from the flat contact 162 to regulate the functionality of the flashlight. When neither the short pogo pin 159 nor the flat contact 162 is electrically connected to the rotary contact 146, the control circuit 138 causes the selected lamp to operate at a low power output (see e.g., FIG. 11 and FIG. 14). When the short pogo pin 159 is electrically connected to the rotary contact 146, but the flat contact 162 is not electrically connected to the rotary contact 146, the control circuit causes the selected lamp to operate at medium power output (see e.g., FIG. 12 and FIG. 15). When the short pogo pin 159 is electrically connected to the rotary contact 146 and the flat contact 162 is electrically connected to the rotary contact 146, the control circuit 138 causes the selected lamp to operate at high power output. Additionally, if the rotary contact 146 is rotated about 140 degrees back and forth with respect to the switching circuit 144 to engage and disengage the short pogo pin 159 and the flat contact 162, the control circuit 138 will receive these signals and responsively change the lamp selection. Similarly, in an embodiment with a third pogo pin, a fourth operating state may be selected when the two longer pogo pins are electrically connected to the rotary contact.

Figure 22:
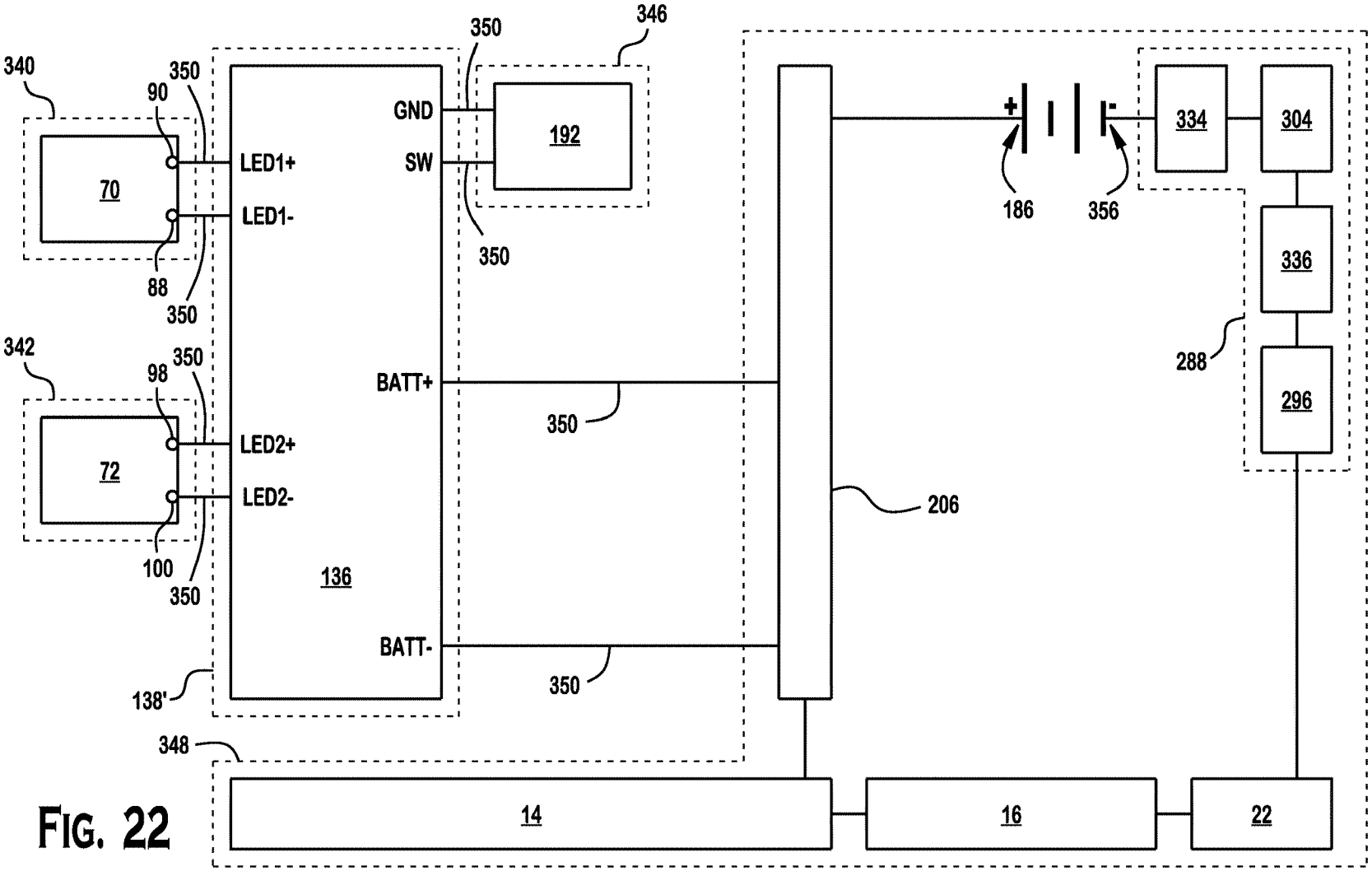
FIG. 22 is a schematic diagram of an exemplary electrical system of the flashlight of FIG. 19.
Figure 23:
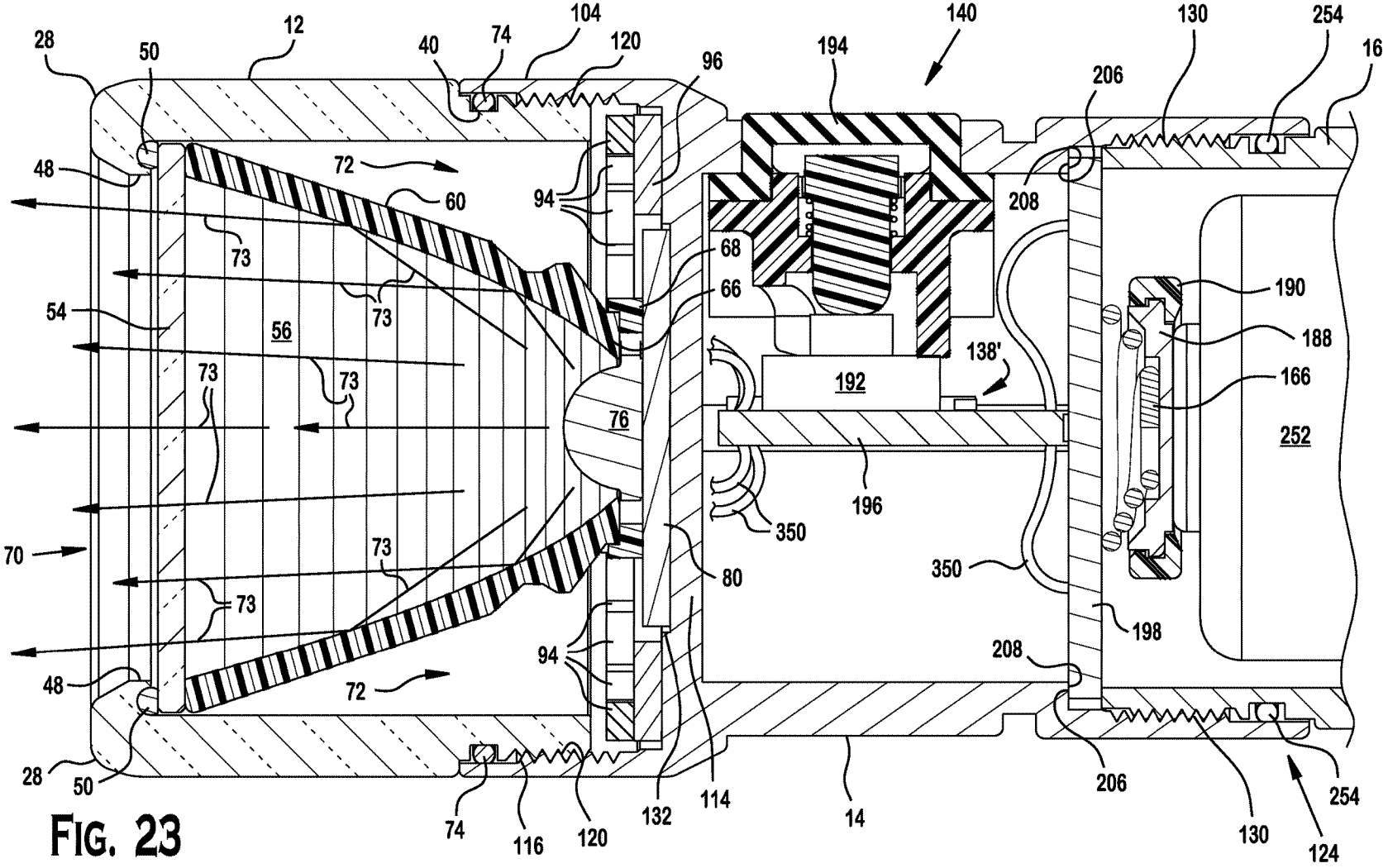
FIG. 23 is a partial view of the flashlight of FIG. 19 in a spot beam operational mode.
Figure 24:
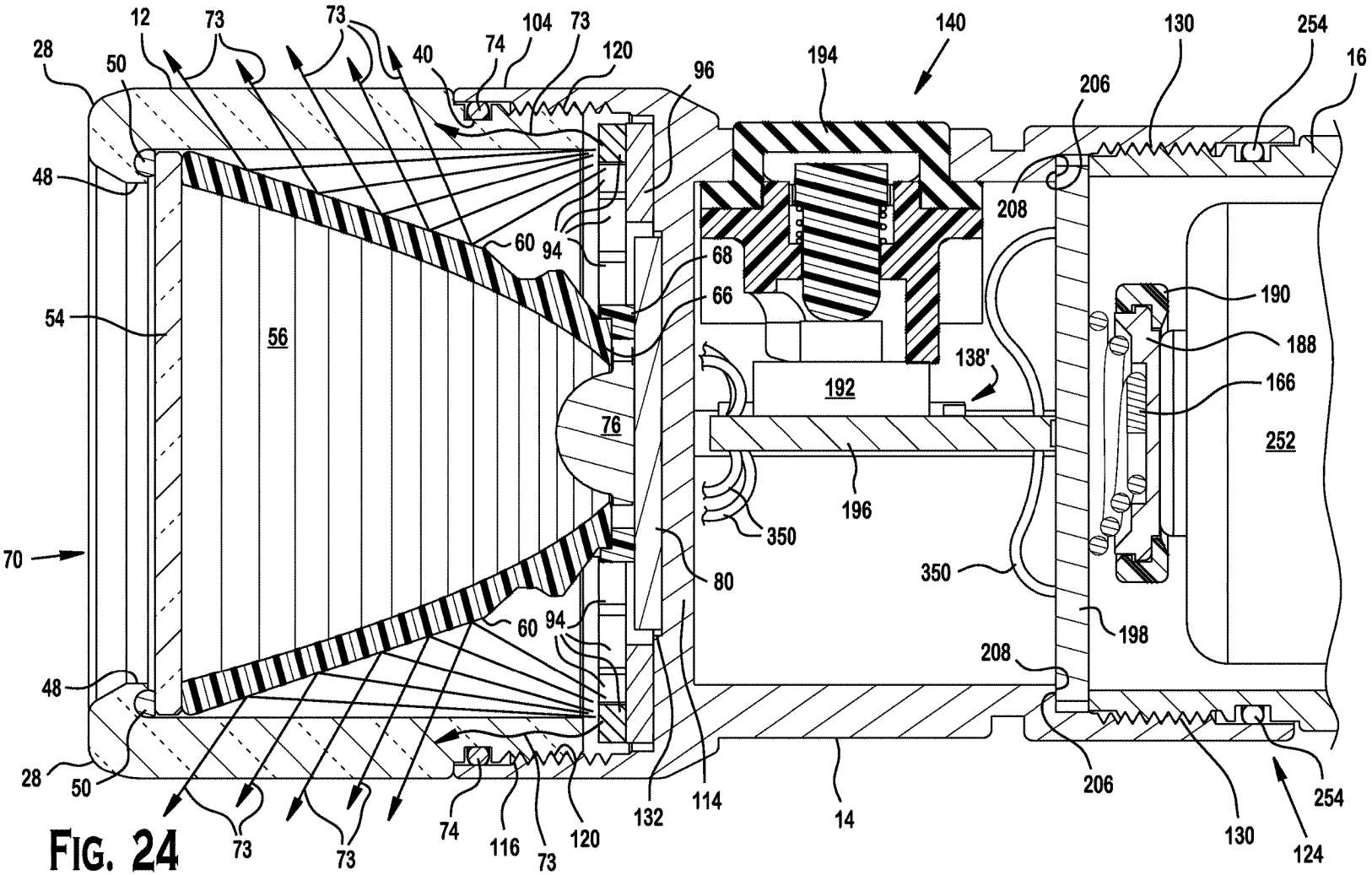
FIG. 24 is a partial view of the flashlight of FIG. 19 in a diffuse light operational mode.
Figure 25:
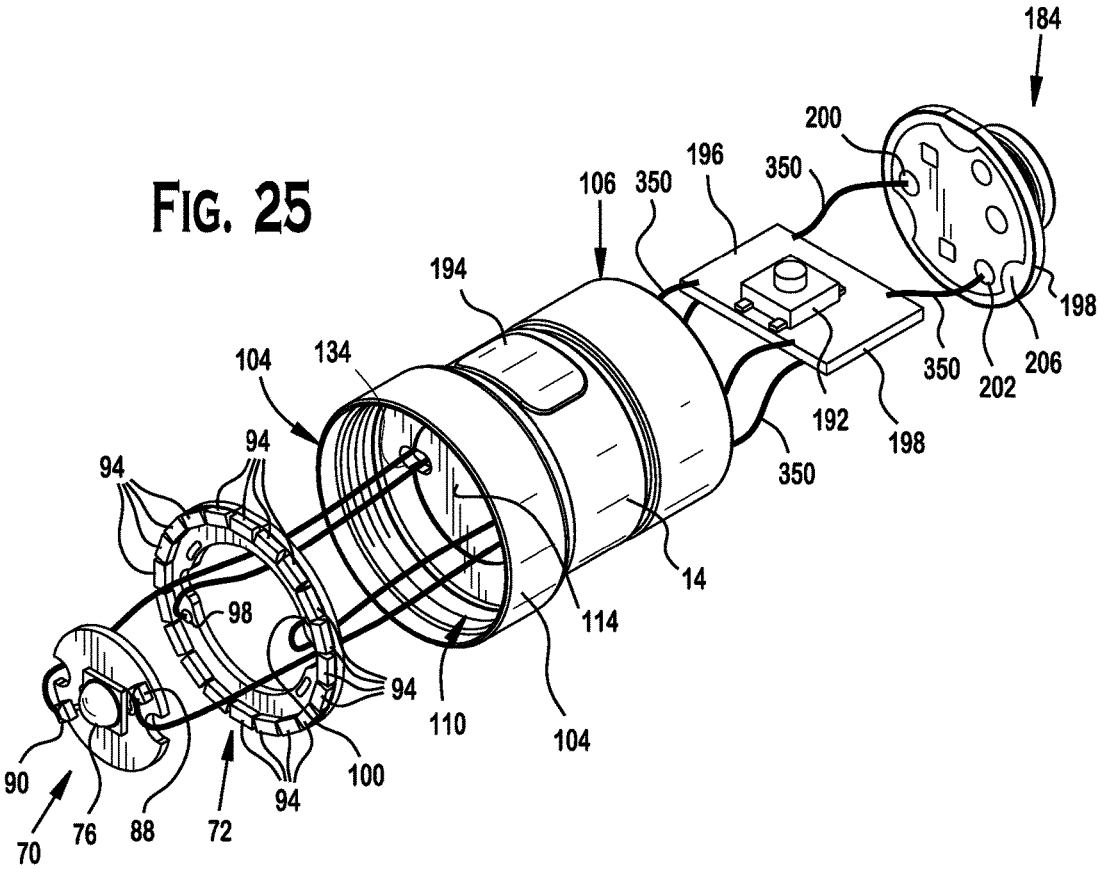
FIG. 25 is a partially exploded view of the forward housing of FIG. 19.
Figure 26:
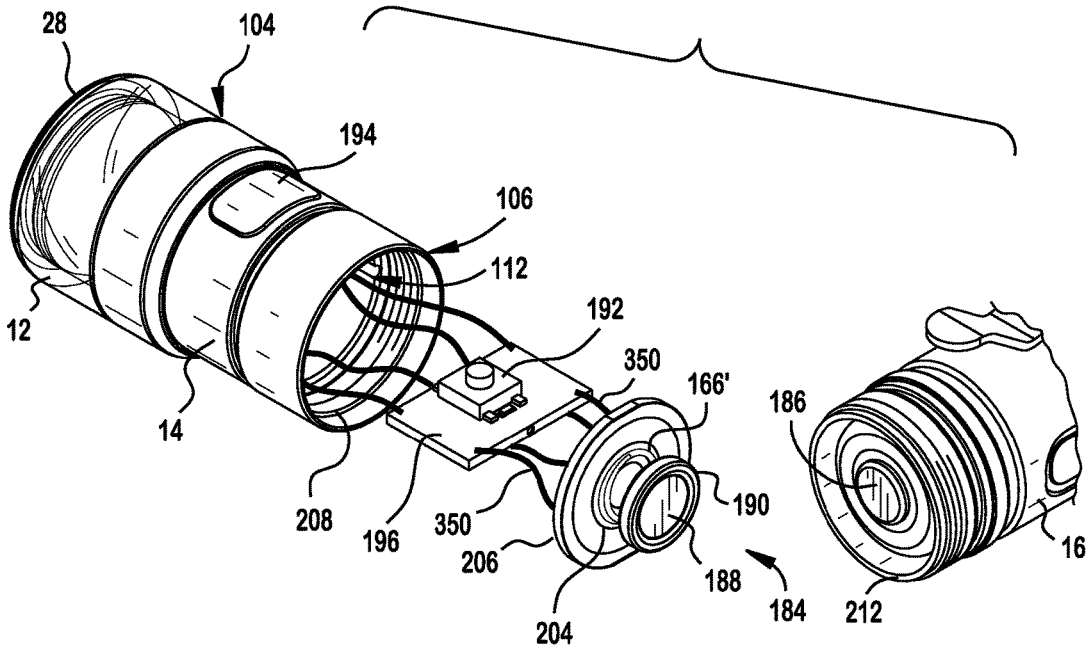
FIG. 26 is a partially exploded view of the forward housing and middle housing of FIG. 19.

Referring to FIG. 22, the primary lamp terminals 88, 90 may be connected by wires 350 to the control circuit 138'. Similarly, the secondary lamp terminals 98, 100 may be connected by wires 350 to the control circuit 138'. Additionally, the control circuit 138' may be connected to the positive terminal 186 of the power supply. The control circuit 138' may be selectively connected to the negative terminal 356 of the power supply through the power switch assembly 288, aft housing 22, middle housing 16, and peripheral ring 150. And, the pushbutton switch 192 may be electrically connected to the signal input 358 of the control circuit 138'.

In use, the power switch 304 may be used to selectively energize the power circuit 348, and the control circuit 318' may receive a first input signal from the pushbutton switch 192 to regulate the functionality of the flashlight. When the pushbutton switch 192 is actuated, the control circuit 138' advances the operational state (or setting) of the selected lamp from low power output to medium power, from medium power output to high power output, and from high power output to low power output. When the pushbutton switch 192 is actuated and held in the actuated position, the control circuit 138' advances the operational mode, for example, from operating the primary lamp 70 to operating the secondary lamp 72 or from operating the secondary lamp 72 to operating the primary lamp 70.

In view of the above, in one embodiment, the present invention may be directed to a lighting and diffuser apparatus. The apparatus may include a reflector having a longitudinal axis, as well as a first end which comprises a first rim having a first diameter and a second rim having a second diameter. The second diameter may be greater than the first diameter. The reflector also may include a second end. The second end may be spaced from the first end along the longitudinal axis and may include a third rim having a third diameter, and a fourth rim having a fourth diameter. The fourth diameter may be greater than the third diameter. The reflector further may include an interior surface extending from the first rim to the third rim. The interior surface may have a truncated parabolodial shape. The reflector also may include an exterior surface extending from the second rim to the fourth rim. The exterior surface may include a first segment that defines a lateral surface of a frustum of a right circular cone.

The apparatus further may include a primary lamp, which is positioned inside the third rim and which extends above the interior surface. The apparatus also may include a secondary lamp which includes an array of light sources facing the first segment, the array of light sources being distributed in a ring adjacent to the second end of the reflector. Also, the apparatus may include a cylindrical member of light transmitting material proximate the reflector. The cylindrical member may include a distal end portion adjacent the first end of the reflector, a proximal end portion adjacent the secondary lamp, and an interior sidewall extending from the distal end portion to the proximal end portion. The interior sidewall may define an interior passage which faces the lateral surface of the reflector such that light from the secondary lamp passes into the proximal end, and such that light from the secondary lamp which is reflected by the lateral surface of the reflector passes into the interior sidewall. The cylindrical member may include an exterior sidewall extending from the distal end portion to the proximal end portion such that light passing through the proximal end portion and light passing through the interior sidewall is emitted from the exterior sidewall to provide a diffuse light.

The primary lamp may include a light emitting diode. The light emitting diode may be a single-die packaged light emitting diode. The primary lamp may have a light output substantially equal to or greater than 1000 lumens as measured by ANSI FL 1-2009 Standard. The primary lamp further may have a light output substantially equal to or greater than 2000 lumens as measured by ANSI FL 1-2009 Standard.

The array of light sources comprising the secondary lamp may be an array of light emitting diodes. The array of light sources may be distributed uniformly around the second end of the reflector.

The reflector may include a reflective coating on the interior surface of the reflector. Also, the reflector may include a reflective coating on the first segment.

The reflector may include a tool attachment site located on the exterior surface of the reflector located between the first segment and the second end of the reflector such that the tool attachment site allows the reflector to be held and manipulated without damaging the reflector. The tool attachment site may include a circumferential groove.

The lighting and diffuser apparatus may include a forward housing. The primary lamp, secondary lamp and cylindrical member may be connected to the forward housing. The primary lamp may be mounted on a metal core printed circuit board (metal core PCB) and the forward housing may dissipate heat conducted by the metal core PCB. The forward housing may include a front inner side wall, the front inner sidewall being opaque and circumscribing a portion of the first segment of the reflector. The cylindrical member may include a translucent engineered material. The translucent engineered material may be a polycarbonate plastic. The polycarbonate plastic may be colored.

In another aspect, the present invention relates to a multi-mode flashlight. The flashlight may include a lighting apparatus and diffuser in accordance with an embodiment of the present invention. The flashlight further may include a primary lamp circuit for driving the primary light source; a secondary lamp circuit for driving the secondary light source; a control circuit electrically connected to the primary light circuit and the secondary light circuit for controlling operation of the primary lamp and the secondary lamp; an electromechanical signaling device electrically connected to the control circuit for generating one or more control circuit input signals for regulating operation of the flashlight; and a power circuit electrically connected to the control circuit for supplying electricity to power the flashlight.

In yet another aspect, the multi-mode flashlight may include a lighting apparatus and diffuser of the present invention, and a power circuit for supplying electricity to power the multi-mode flashlight. The power circuit may be electrically connected to the primary lamp and the secondary lamp. The multi-mode flashlight further may include a control circuit connected to the power circuit for controlling operation of the primary lamp and the secondary lamp. The flashlight also may include an electromechanical signaling device electrically connected to the control circuit for generating one or more control circuit input signals for regulating operation of the flashlight.

The control circuit may include a microcontroller which is configured to receive the one or more control circuit input signals and which may be programmed to responsively operate the flashlight in one of a plurality of operational modes. The plurality of operational modes may include a first operational mode in which the first primary lamp emits light and the secondary lamp does not emit light, and a second operational mode in which the first primary lamp does not emit light and the secondary lamp emits light.

The first operational mode may include a first plurality of operational states, which may include a first operating state in which the first primary lamp produces a directed beam of light that is emitted from the first end of the reflector such that the directed beam of light may be characterized by a low level of light output relative to the other operating states in the first operational mode. The first operational mode further may include a second operating state in which the primary lamp produces a directed beam of light that is emitted from the first end of the reflector such that the directed beam of light may be characterized by a medium level of light output relative to the other operating states in the first operational mode. Additionally, the first operational mode may include a third operating state in which the primary lamp produces a directed beam of light that is emitted from the first end of the reflector such that the directed beam of light may be characterized by a high level of light output relative to the other operating states in the first operational mode.

The second operational mode may include a second plurality of operational states, which may include a fourth operating state in which the secondary lamp produces diffused light that is emitted from the cylindrical member, the diffused light being characterized by a low level of light output relative to the other operating states in the second operational mode; a fifth operating state in which the secondary lamp produces diffused light that is emitted from the cylindrical member, the diffused light being characterized by a medium level of light output relative to the other operating states in the second operational mode; and a sixth operating state in which the secondary lamp produces diffused light that is emitted from the cylindrical member, the diffused light being characterized by a high level of light output relative to the other operating states in the second operational mode.

The first operational mode may include a seventh operating state in which the primary lamp produces a directed beam of light that is emitted from the first end of the reflector, the directed beam of light being characterized by a very high level of light output relative to the other operating states in the first operational mode.

The first operational mode may include an eighth operating state in which the primary lamp produces a directed beam of light that is emitted from the first end of the reflector, the directed beam of light being a strobing light.

The electromechanical signaling device may include a switching device. The electromechanical signaling device may include a pushbutton switch. The electromechanical signaling device may include a rotary switch. The rotary switch may include a switching circuit printed circuit board which includes a plurality of signal output leads, and a rotary contact which is operatively associated with the switching circuit printed circuit board such that the rotary contact selectively engages the switching circuit printed circuit board to electrically connect the rotary contact with one or more of the plurality of signal output leads. The switching circuit printed circuit board further may include one or more pogo pins and a fixed contact facing the rotary contact. Additionally, the switching circuit printed circuit board may include first, second and third signal output leads and first and second pogo pins, such that the first pogo pin is connected to the first input signal lead, the second pogo pin is connected to the second input signal lead, and the fixed contact is connected to the third input signal lead. The rotary contact, selectively, may oscillate with respect to the switching circuit printed circuit board between a first position, a second position and a third position. In the first position, the rotary contact may be spaced from the switching circuit printed circuit board by a first distance and may engage the first pogo pin. In the second position, the rotary contact may be spaced from the switching circuit printed circuit board by a second distance and may engage the first pogo pin and the second pogo pin. In the third position, the rotary contact may engage the first pogo pin, the second pogo pin, and the fixed contact. For example, the first distance may range from approximately 0.5 mm to approximately 2 mm. The first distance may be substantially equal to or greater than 1.5 mm. The second distance may be substantially equal to one half of the first distance.

The electromechanical signaling device may include a selectable output level switching means for bringing at least two conductors into contact with each other in a controlled manner by a user of the flashlight.

While it has been illustrated and described what at present are considered to be a preferred embodiment of the present invention, it will be understood by those skilled in the art that various changes and modifications may be made, and equivalents may be substituted for elements thereof without departing from the true scope of the invention. For example, the specific light output levels of the flashlight, the mechanism of changing the mode (or state) of operation of the flashlight, as well as the location of the electromechanical signaling device may be different than as expressly disclosed herein. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A lighting and diffuser apparatus for a flashlight comprising:

a reflector having a longitudinal axis, which comprises
- a first end, which comprises
  - a first rim having a first diameter, and
  - a second rim having a second diameter,
- a second end, which is spaced from the first end along the longitudinal axis and which comprises
  - a third rim having a third diameter, and
  - a fourth rim having a fourth diameter,
- an interior surface extending from the first rim to the third rim, the interior surface having a truncated parabolodial shape, and
- an exterior surface extending from the second rim to the fourth rim and which comprises a first segment that defines a lateral surface of a frustum of a right circular cone;

a primary lamp, which is positioned inside the third rim and which extends above the interior surface;

a secondary lamp which comprises an array of light sources facing the first segment, the array of light sources being distributed in a ring adjacent to the second end of the reflector; and a cylindrical member of light transmitting material proximate the reflector which comprises a distal end portion adjacent the first end of the reflector, a proximal end portion adjacent the secondary light source, an interior sidewall extending from the distal end portion to the proximal end portion, the interior sidewall defining an interior passage which faces the lateral surface of the reflector such that light from the secondary light source passes into the proximal end, and such that light from the secondary light source which is reflected by the lateral surface of the reflector passes into the interior sidewall, and an exterior sidewall extending from the distal end portion to the proximal end portion such that light passing through the proximal end portion and light passing through the interior sidewall is emitted from the exterior sidewall to provide a diffuse light.

2. The lighting and diffuser apparatus of claim 1, wherein the primary lamp comprises a light emitting diode.

3. The lighting and diffuser apparatus of claim 2, wherein the light emitting diode is a single-die packaged light emitting diode.

4. The lighting and diffuser apparatus of claim 2, wherein the primary lamp has a light output substantially equal to or greater than 1000 lumens as measured by ANSI Fl 1-2009 Standard.

5. The lighting and diffuser apparatus of claim 4, wherein the primary lamp has a light output substantially equal to or greater than 2000 lumens as measured by ANSI Fl 1-2009 Standard.

6. The lighting and diffuser apparatus of claim 4, wherein the array of light sources comprising the secondary lamp are an array of light emitting diodes.

7. The lighting and diffuser apparatus of claim 6, wherein the array of light sources are distributed uniformly around the second end of the reflector.

8. The lighting and diffuser apparatus of claim 1, wherein the reflector further comprises a reflective coating on the interior surface of the reflector.

9. The lighting and diffuser apparatus of claim 8, wherein the reflector further comprises a reflective coating on the first segment of the reflector.

10. The lighting and diffuser apparatus of claim 8, further comprising a tool attachment site located on the exterior surface of the reflector located between the first segment and the second end of the reflector such that the tool attachment site allows the reflector to be held and manipulated without damaging the reflector.

11. The lighting and diffuser apparatus of claim 10, wherein the tool attachment site comprises a circumferential groove.

12. The lighting and diffuser apparatus of claim 8, further comprising a forward housing, wherein the primary lamp, secondary lamp and cylindrical member are connected to the forward housing.

13. The lighting and diffuser apparatus of claim 12, wherein the primary lamp is mounted on a metal core PCB and the forward housing dissipates heat conducted by the metal core PCB.

14. The lighting and diffuser apparatus of claim 13, wherein the forward housing comprises a front inner side wall, the front inner sidewall being opaque and circumscribing a portion of the first segment of the reflector.

15. The lighting and diffuser apparatus of claim 14, wherein the cylindrical member comprises a translucent engineered material.

16. The lighting and diffuser apparatus of claim 15, wherein the translucent engineered material comprises a polycarbonate plastic.

17. The lighting and diffuser apparatus of claim 16, wherein the polycarbonate plastic is colored.

18. A multi-mode flashlight comprising:

a lighting apparatus and diffuser of claim 1;

a power circuit for supplying electricity to power the flashlight, the power circuit being selectively electrically connected to the primary lamp for operating the primary lamp and selectively electrically connected to the secondary lamp for operating the secondary lamp;

a control circuit electrically connected to the power circuit for controlling operation of the primary lamp and the secondary lamp; and an electromechanical signaling device electrically connected to the control circuit for generating one or more control circuit input signals for regulating operation of the flashlight.

19. The multi-mode flashlight of claim 18, wherein the control circuit comprises a microcontroller which is configured to receive the one or more control circuit input signals and is programmed to responsively operate the flashlight in one of a plurality of operational modes, which comprise a first operational mode in which the primary lamp emits light and the secondary lamp does not emit light; and a second operational mode in which the primary lamp does not emit light and the secondary lamp emits light.

20. The multi-mode flashlight of claim 19, wherein the first operational mode comprises a first plurality of operational states, which comprise a first operating state in which the primary lamp produces a directed beam of light that is emitted from the first end of the reflector, the directed beam of light being characterized by a low level of light output relative to the other operating states in the first operational mode;

a second operating state in which first primary lamp produces a directed beam of light that is emitted from the first end of the reflector, the directed beam of light being characterized by a medium level of light output relative to the other operating states in the first operational mode; and a third operating state in which the primary lamp produces a directed beam of light that is emitted from the first end of the reflector, the directed beam of light being characterized by a high level of light output relative to the other operating states in the first operational mode.

21. The multi-mode flashlight of claim 20, wherein the second operational mode comprises a second plurality of operational states, which comprise a fourth operating state in which the secondary lamp produces diffused light that is emitted from the cylindrical member, the diffused light being characterized by a low level of light output relative to the other operating states in the second operational mode;

a fifth operating state in which the secondary lamp produces diffused light that is emitted from the cylindrical member, the diffused light being characterized by a medium level of light output relative to the other operating states in the second operational mode; and a sixth operating state in which the secondary lamp produces diffused light that is emitted from the cylindrical member, the diffused light being characterized by a high level of light output relative to the other operating states in the second operational mode.

22. The multi-mode flashlight of claim 19, wherein the first operational mode comprises a seventh operating state in which the first primary lamp produces a directed beam of light that is emitted from the first end of the reflector, the directed beam of light being characterized by a very high level of light output relative to the other operating states in the first operational mode.

23. The multi-mode flashlight of claim 22, wherein the first operational mode comprises a eighth operating state in which the first primary lamp produces a directed beam of light that is emitted from the first end of the reflector, the directed beam of light being a strobing light.

24. The multi-mode flashlight of claim 19, further comprising a third operational mode in which the first primary lamp emits light and the secondary lamp emits light.

25. The multi-mode flashlight of claim 24, wherein the primary lamp and the secondary lamp share power from the electrical circuit approximately equally.

26. The multi-mode flashlight of claim 18, wherein the electromechanical signaling device comprises a switching device.

27. The multi-mode flashlight of claim 26, wherein the electromechanical signaling device comprises a pushbutton switch.

28. The multi-mode flashlight of claim 26, wherein the electromechanical signaling device comprises a rotary switch.

29. The multi-mode flashlight of claim 28, wherein the rotary switch comprises:

a switching circuit printed circuit board, which includes a plurality of signal output leads; and a rotary contact which is operatively associated with the switching circuit printed circuit board such that the rotary contact selectively engages the switching circuit printed circuit board to electrically connect the rotary contact with one or more of the plurality of signal output leads.

30. The multi-mode flashlight of claim 29, wherein the switching circuit printed circuit board further comprises one or more pogo pins and a fixed contact facing the rotary contact.

31. The multi-mode flashlight of claim 30, wherein the switching circuit printed circuit board comprises first, second and third signal output leads and first and second pogo pins, such that the first pogo pin is connected to the first input signal lead, the second pogo pin is connected to the second input signal lead, and the fixed contact is connected to the third input signal lead.

32. The multi-mode flashlight of claim 31, wherein the rotary contact selectively oscillates with respect to the switching circuit printed circuit board between a first position, a second position and a third position such that in the first position, the rotary contact is spaced from the switching circuit printed circuit board by a first distance and engages the first pogo pin, such that in the second position, the rotary contact is spaced from the switching circuit printed circuit board by a second distance and engages the first pogo pin and the second pogo pin, and such that in the third position, the rotary contact engages the first pogo pin, the second pogo pin, and the fixed contact.

33. The multi-mode flashlight of claim 32, wherein the first distance is substantially equal to or greater than 0.8 mm.

34. The multi-mode flashlight of claim 33, wherein the second distance is substantially equal to one half of the first distance.

35. The multi-mode flashlight of claim 26, wherein the electromechanical signaling device comprises a selectable output level switching means for bringing at least two conductors into contact with each other in a controlled manner by a user of the flashlight.

36. The multi-mode flashlight of claim 1, wherein the second diameter D2 is greater than the first diameter D1 and the fourth diameter D4 is greater than the third diameter D3.

37. A multi-mode flashlight comprising:

a lighting apparatus and diffuser of claim 1;

a primary lamp circuit for driving the primary light source;

a secondary lamp circuit for driving the secondary light source;

a control circuit electrically connected to the primary light circuit and the secondary light circuit for controlling operation of the primary lamp and the secondary lamp;

an electromechanical signaling device electrically connected to the control circuit for generating one or more control circuit input signals for regulating operation of the flashlight; and a power circuit electrically connected to the control circuit for supplying electricity to power the flashlight.

* * * * *